US011118418B2

(12) United States Patent
Rivlin

(10) Patent No.: US 11,118,418 B2
(45) Date of Patent: Sep. 14, 2021

(54) SUBSEA WELLHEAD SYSTEM WITH FLEXIBLE OPERATION

(71) Applicants: EASYTREE AS, Oslo (NO); Haran Rivlin, Oslo (NO)

(72) Inventor: Haran Rivlin, Oslo (NO)

(73) Assignees: Haran Rivlin, Oslo (NO); EASYTREE AS, Oslo (NO)

( * ) Notice: Subject to any disclaimer, the term of this patent is extended or adjusted under 35 U.S.C. 154(b) by 0 days.

(21) Appl. No.: 16/758,412

(22) PCT Filed: Oct. 23, 2017

(86) PCT No.: PCT/NO2017/000027
§ 371 (c)(1),
(2) Date: Apr. 23, 2020

(87) PCT Pub. No.: WO2019/083371
PCT Pub. Date: May 2, 2019

(65) Prior Publication Data
US 2020/0248522 A1 Aug. 6, 2020

(51) Int. Cl.
*E21B 33/038* (2006.01)
*E21B 33/043* (2006.01)
*E21B 33/076* (2006.01)
*E21B 34/04* (2006.01)

(52) U.S. Cl.
CPC ..... *E21B 33/038* (2013.01); *E21B 33/043* (2013.01); *E21B 33/076* (2013.01); *E21B 34/04* (2013.01)

(58) Field of Classification Search
CPC .... E21B 33/035; E21B 33/038; E21B 33/043; E21B 33/076; E21B 34/04; E21B 34/025
See application file for complete search history.

(56) References Cited

U.S. PATENT DOCUMENTS 8,794,334 B2 * 8/2014 June ..... E21B 43/013 166/368
2006/0108120 A1 * 5/2006 Saucier ..... E21B 34/04 166/344
2013/0000918 A1 * 1/2013 Voss ..... E21B 34/04 166/344

* cited by examiner

*Primary Examiner* — James G Sayre
(74) *Attorney, Agent, or Firm* — Mark M. Friedman

(57) ABSTRACT

Subsea petroleum wellhead assembly, which main parts are wellhead flange, tubing-hanger block (TH-block), flow-block, Christmas tree (XT), tubing hanger (TH) and tubing-hanger extension. The system's advantage is that it allows retrieval and installation of either the XT or the TH independently of each other. That is achieved by breaking the direct connection between the XT and the TH, and instead leading the production flow through a bypassing flow-block that is integrated in the TH-block. The flow-block runs outside the TH and XT, and bridges between them by help of a flow-connector and flow-loops. By breaking the direct connection between the TH and the XT, it is possible to install and retrieve them independently of each other. Over the well's lifetime, the saving in operation expenses—compared with a vertical XT—is estimated to be at least 10 million US$ compared with a horizontal XT.

12 Claims, 18 Drawing Sheets

Figure 1-A

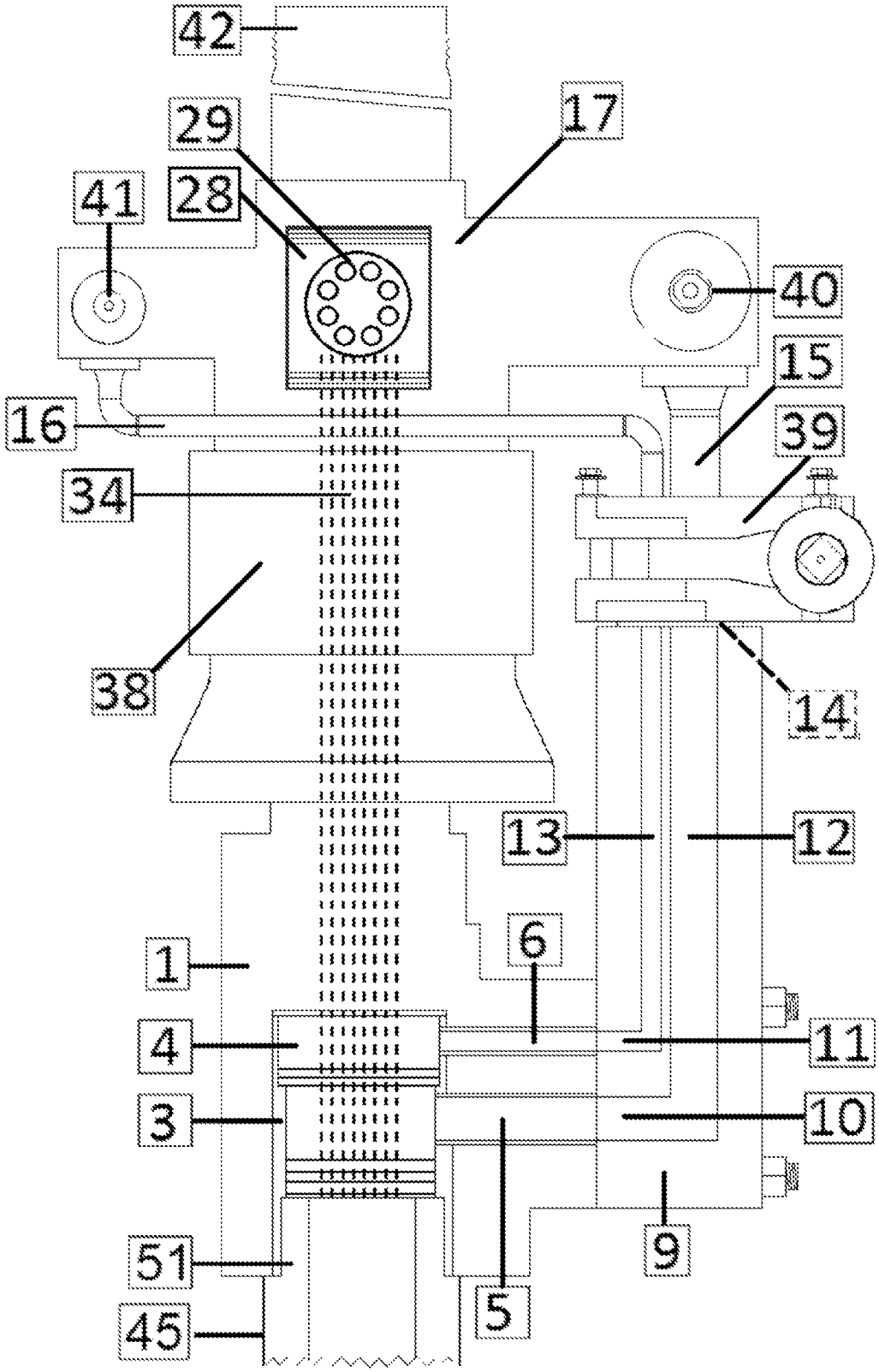
Figure 3-A

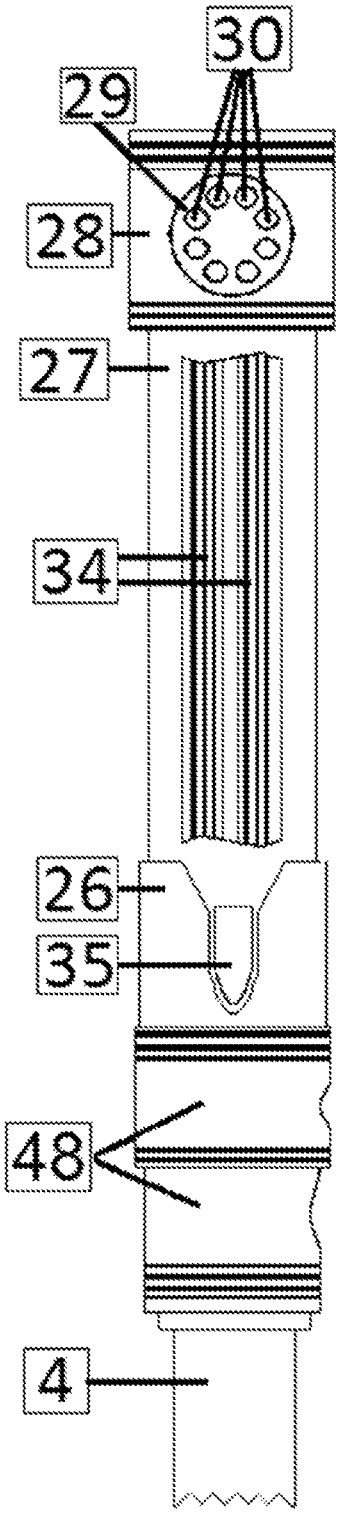
Figure 3-B
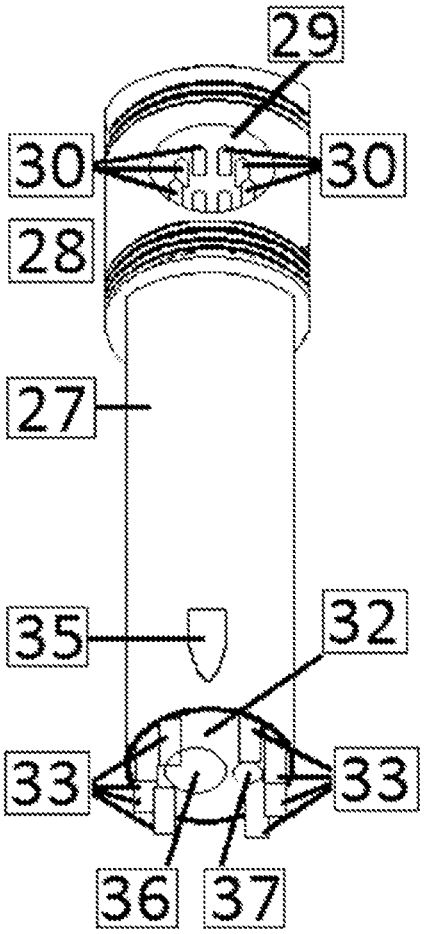
Figure 3-C

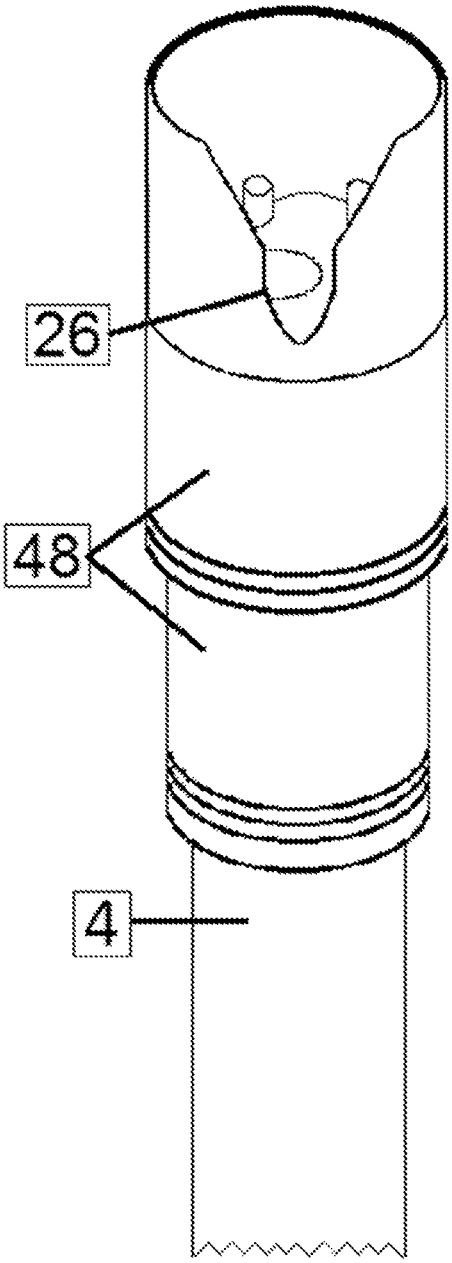
Figure 4-A

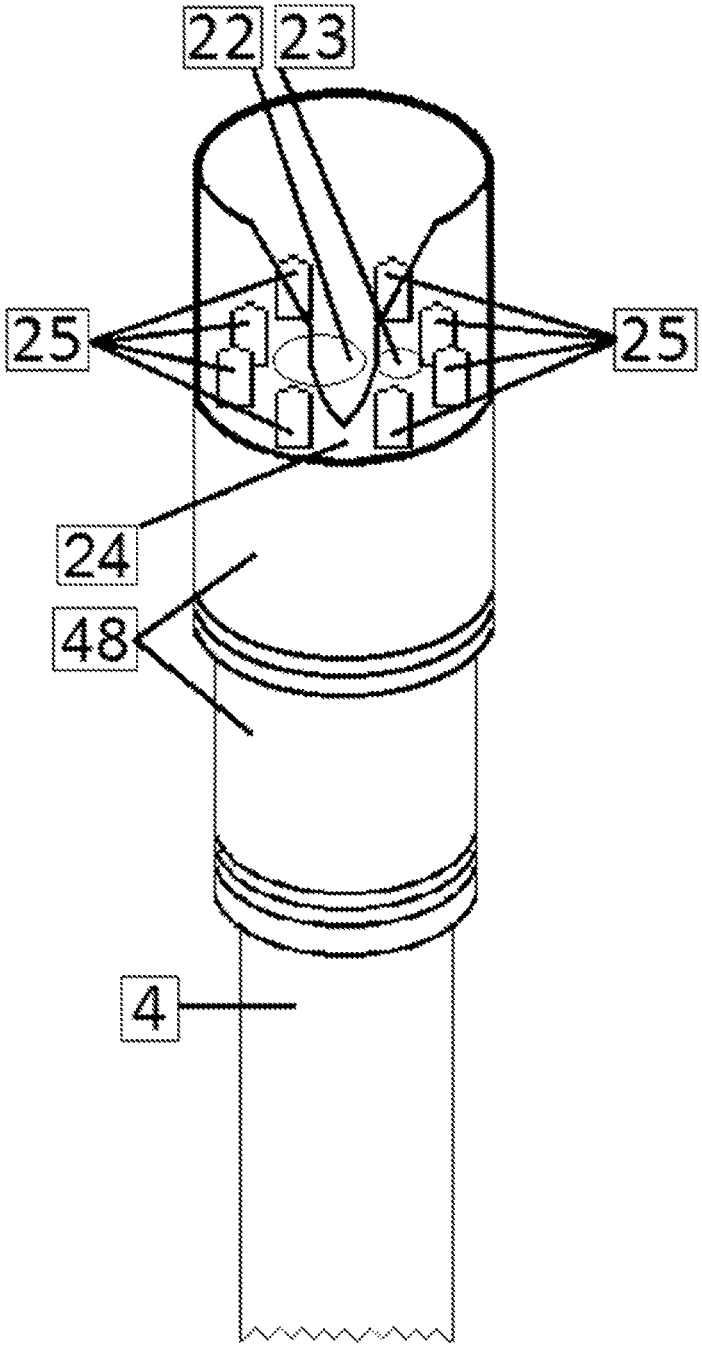
Figure 4-B

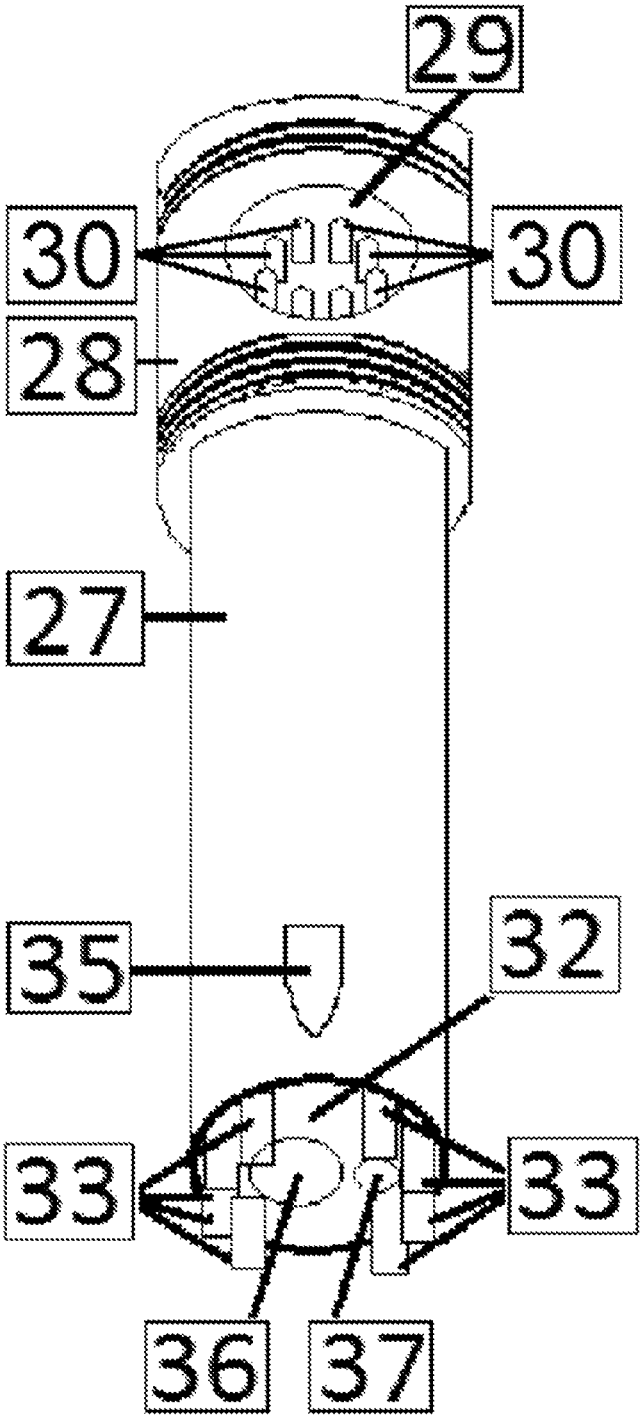
Figure 5-A

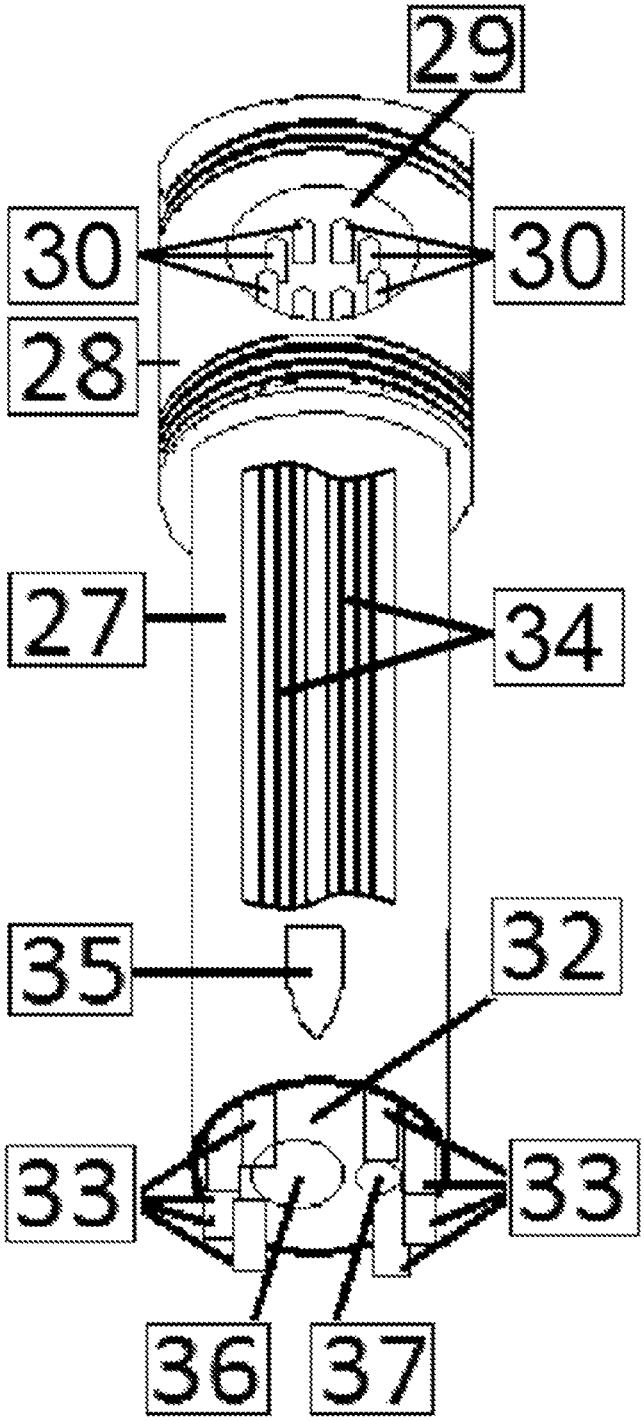
Figure 5-B

Figure 6-A

SUBSEA WELLHEAD SYSTEM WITH FLEXIBLE OPERATION

FIELD OF THE INVENTION

This invention relates to subsea wellhead systems and more specifically to the following components thereof: wellhead, tubing-hanger block, tubing hanger and Christmas tree. This invention applies to both production wells and water-injection wells. Whenever the term 'production' is used— it applies also to 'water-injection'.

Glossary

| Term | Explanation |
|---|---|
| AMV | Annulus master valve |
| APV | Annulus primary valve |
| BOP | Blowout preventer |
| El. | Electronic |
| HP | Hybrid penetrator |
| Hyd. | Hydraulic |
| MVB | Master valve block |
| PMV | Production master valve |
| PPV | Production primary valve |
| TH | Tubing hanger |
| TH-Block | Tubing hanger block |
| TH-Extension | Tubing hanger extension |
| XT | Subsea Christmas tree |

BACKGROUND OF THE INVENTION

During the lifetime of subsea wellhead systems, both the Christmas tree (XT) and tubing with tubing hanger (TH) have to be retrieved for maintenance or well intervention. With today's technology, you either have to retrieve the XT in order to pull out the tubing (in vertical XTs), or pull out the tubing in order to retrieve the XT (in horizontal XTs).

This lack of operational flexibility translates into huge expenses: Retrieving the XT only in order to pull out the TH constitutes a significant cost. Retrieving the TH only in order to be able to retrieve the XT constitutes yet much larger cost. Also, these additional operations present safety and environmental risks, as in any subsea operation.

PRIOR ART

Subsea Petroleum Wells

All subsea wells for oil and gas comprise the following three items: wellhead, tubing hanger (TH) and Christmas tree (XT). Many additional components complement the subsea well, but are not concerned by this patent, and are therefore not discussed here.

The wellhead is always installed subsea before the TH and XT. The wellhead flange connects with a set of casings that are inserted into the ground and suspend at the upper part of the flange. These casings are not concerned by this patent, and are therefore not discussed.

The upper part of the wellhead features a connection-hub that interfaces the XT. In most modern wells, the external profile of the connection-hub at the top of the wellhead is identical, no matter who produces them and who operates them. That connection-hub's profile and dimension are an international industry standard.

The internal profile of the upper part of the wellhead can either be a simple round bore, with an inner diameter of 18¾ inch (476 mm), or it can be shaped to house and interface the TH, in the cases where the TH is installed inside the wellhead. That will be described further below.

Types of Christmas Trees

There are many types of XTs in the subsea industry, but most of the different types can be grouped within the main two categories: horizontal XT and vertical XT. The main operational difference between the two categories is this: the horizontal tree is installed subsea prior to installing the tubing pipes and TH, while the vertical tree is installed subsea after the tubing pipes and TH have been installed.

The reason for the names—horizontal or vertical—is this: in the horizontal XT, the flow of oil through the production master valve is on the horizontal plane, while in the vertical XT, the flow of oil through the production master valve is on the vertical plane.

However, the names tell very little about the real differences between the horizontal- and vertical XTs. It is the order of installation and retrieval that constitute the most important operational difference.

Blowout Preventer

The blowout preventer (BOP) is a central item in the subsea operation. The role of the BOP is to secure the well against uncontrolled spill of oil during installation and maintenance of the subsea components. The BOP can be installed on top of the wellhead, or on top of the XT. The BOP constitutes a significant cost, since it is operated from costly vessels and only running it subsea can take 24 hours, before it is operational.

Installation and Retrieval Sequence

Here is where the differences between the horizontal- and vertical XTs matters. To start with installation: a horizontal XT requires two trips of the BOP. The first time is for drilling and running the casings of the well; the second time is for drilling and running the tubing. The reason for that is that the TH is installed inside the horizontal XT, after the XT has been installed on the wellhead. The BOP therefore must be retrieved from the wellhead—to allow installation of the horizontal XT—and then installed again, this time on top of the XT.

The vertical XT's TH with tubing is installed directly into the wellhead, before the vertical XT is installed subsea. The BOP, therefore, is required to run subsea only one time, during which both the casings and tubing are drilled-for and installed.

During the well's lifetime, the choice of XT type—horizontal or vertical—will affect the cost of operation and maintenance. Retrieving a vertical tree for maintenance is much cheaper, since you don't have to pull out the tubing first. But if you want to access the well and pull out the tubing—you will have to retrieve the XT first, and that is of course an extra cost.

With the horizontal XT it is the opposite: you don't have to retrieve the tree in order to pull out the tubing; but if you have to retrieve the XT for maintenance—you must pull out the tubing first. A recent estimate puts the cost of that additional operation at the area of 40 million dollar.

Design of the Christmas Trees

Besides the aforesaid operational differences between the horizontal- and vertical XTs, there are significant differences in their design, and consequently in the way they interface their respective tubing hangers (TH). The horizontal- and vertical tubing hangers are very different.

The vertical XT's TH sits inside the wellhead, and its two vertical bores—one for production and one for annulus—interface the XT, which sits on top of the wellhead above it, by two vertical stingers. The vertical production- and annulus bores inside the vertical XT's master valve block (MVB)—also known as 'spool'—feature valves that control the flow through those bores.

The horizontal XT's TH sits inside the MVB of the horizontal XT, and interfaces horizontal bores in the horizontal XT's MVB. The horizontal production- and annulus bores in the horizontal XT's MVB feature valves that control the flow through those bores.

Interface with the Well's Hydraulic- and Electronic Lines

Another important difference between horizontal and vertical THs is the way they interface the hydraulic- and electronic lines that come from the XT and go through the TH and the tubing down to the well's hole.

In the horizontal XT, a hydraulic-and-electronic-penetrator—also known as 'hybrid penetrator'—is mounted on the wall of the MVB and accesses the TH through a set of corresponding male-female couplers. The couplers can mate only after the TH has been installed inside the XT's MVB. Mating is performed by a remotely operated vehicle, which strokes the hybrid penetrator's movable couplers into the TH's couplers. Inversely, the hybrid penetrator's couplers are retracted from the TH before pulling out the TH and the tubing from the XT.

In the vertical XT, there is no hybrid penetrator. The hydraulic and electronic lines are led through the XT's MVB, and end with couplers at the bottom of the XT. When the XT lands onto the wellhead (and thereby also on top of the TH), the couplers at the bottom of the XT mate their corresponding couplers at the top of the TH.

Wireline Plugs

Wireline plugs are barriers that block the bores in the TH, mainly during installation and maintenance. These plugs are installed into the bores of the TH, both in the horizontal- and vertical XT. The wireline plugs constitute barriers inside the TH's bores, and hinder passage of oil to the environment.

The wirelines plugs in the vertical TH are removed during normal operation of the vertical XT. In the horizontal XT, the wireline plug remains in the upper end of the production bore of the horizontal TH during normal operation of the horizontal XT.

In both horizontal- and vertical XTs, limited maintenance operations of the tubing pipes are possible through the production bores of the THs. To allow that, the wireline plugs must be removed.

Christmas Tree Re-Entry Hub

Horizontal XTs feature a hub at their top (also known as re-entry hub), with an external profile that is identical to the profile of the wellhead's connection-hub. That allows the BOP and other workover equipment to land and lock onto the XT, in order to run or pull out the tubing, or for any other intervention in the well.

Vertical XTs can have different hubs at their top, since there is no scenario that necessitates landing the BOP on top of a vertical XT. That allows the vertical XT's MVB to have a slimmer profile, thereby reducing weight and cost.

On the hub of the vertical XT sits a pressure cap during normal operation. This is to secure against oil leakage, since the vertical bores in the MVB interface the well and reach all the way to the top of the MVB.

On the hub of the horizontal XT there must be a debris cap; but not always this cap is also a pressure cap, since the pressure may be contained in the TH by means of the wireline plugs.

Remaining Features of the Christmas Tree

All other features of the horizontal- and vertical XTs are similar, and are not affected by this patent. Therefore we do not mention them here.

Drawbacks of the Existing Technology

The most remarkable drawback of the vertical- and horizontal XTs is the lack of operational flexibility. i.e., you either have to retrieve the XT in order to pull out the tubing (in vertical XTs), or pull out the tubing in order to retrieve the XT (in horizontal XTs). Retrieving the XT only in order to access the TH constitutes a significant cost. Retrieving the TH only in order to be able to retrieve the XT constitutes yet much larger cost. Also, these additional operations present safety and environmental risks, as in any subsea operation.

Consequently, oil companies may postpone maintenance operations, which result in decreased production and loss of income.

Moreover, planning the field and deciding which XT to use—horizontal or vertical—becomes much more complicated and expensive. In fact, it is partly a gambling game, predicting how the reservoir will behave during the expected 25 years (average life time) of production, and which component will have to be retrieved more often during the well's lifetime. Of course, a wrong decision spells a gigantic cost to the operator, in form of additional retrieval operations from very expensive rigs.

Review of Several Examples of Prior-Art's Solutions

The following patents represent typical Christmas tree solutions:

US 20040188083 A1

Description copied from https://google.com/patents/US20040188083?cl=no

A flow completion system for controlling the flow of fluid from a well bore comprises a tubing spool which includes a central bore that extends axially therethrough and a production outlet which communicates with the central bore. A tubing hanger is supported in the central bore and includes a production bore that extends axially therethrough and a production passageway that communicates between the production bore and the production outlet. A first closure member is positioned in the production bore above the production passageway, and a first metal seal is positioned concentrically between the tubing hanger and the central bore above the production passageway. In addition, a second closure member is positioned in the production bore above the first closure member, and a second metal seal is positioned concentrically between the tubing hanger and the central bore above the first seal. In this manner, the first closure member and the first seal comprise a first pressure-containing barrier between the well bore and a surrounding environment, and the second closure member and the second seal comprise a second pressure-containing barrier between the well bore and the environment.

U.S. Pat. No. 6,076,605 A

Description copied from https://www.google.com/patents/US6076605

A subsea wellhead assembly has a tubular housing having a sidewall, an axial bore, and a housing lateral passage extending from the bore through the sidewall. A blocking sleeve fits around the housing to block the housing lateral passage while drilling through the housing. A tubing hanger is secured to a string of tubing and landed in the housing. The tubing hanger has a vertical passage which communicates with the tubing and a tubing lateral passage which extends from the vertical passage and registers with the housing lateral passage. A lower annulus port is in the sidewall of the housing below the lower seal and leads to a tubing annulus. An upper annulus port is in the sidewall of the housing above the upper seal and leads to the bore of the housing. A tree block having a central opening for receiving the housing is lowered over the housing after removal of the blocking sleeve. The tree block has a tree production passage which registers with the housing lateral passage for directing flow of production fluid from the well. A production valve is mounted to the tree block for opening and closing the tree production passage. A bypass passage in the tree block connects the upper and lower annulus ports to communicate the bore above the tubing hanger with the tubing annulus.

Solutions that Attempt Operational Flexibility

We know of the following patents that offer independent retrieval of the XT or TH:

US 20140048278 A1

Description copied from http://www.google.com/patents/US20140048278 Subsea well assembly having a Xmas tree and wellhead. From a tubing hanger a tubing extends into the well. A part of a production flow passage extends vertically from the tubing hanger in a vertical bore of the Xmas tree. A fail close production master valve is arranged in the production flow passage. The tubing hanger is arranged below the Xmas tree, such as in the wellhead. The Xmas tree exhibits a branch that deviates from the vertical bore, which branch constitutes part of the production flow passage. The fail close type production master valve is arranged in the branch.

EP 0611874 B1

Description copied from http://www.google.com/patents/US20140048278

(This link is to another patent, which in its description contains a description of EP 0611874 B1.) a subsea wellhead assembly adapted in such way that the operator can remove the tubing without removing the Xmas tree, and remove the Xmas tree without removing the tubing. The tubing is suspended in a lower tubing hanger arranged in the wellhead housing. The tubing can be removed through the tree and a blowout preventer (BOP). When removing the tree, a plug is set in the lower tubing hanger within the wellhead housing. During production, the production flow is guided from the lower tubing hanger up to an upper tubing hanger that exhibits a lateral port that registers with an outlet port in the tree. The upper tubing hanger (referred to as a false tubing hanger) and a tree cap installed in the tree constitute two barriers.

US 20070246220 A1

Description copied from http://www.google.com/patents/US20070246220

A subsea wellhead assembly has a tubing hanger landed in a wellhead housing. A spool lands on the wellhead housing and has a bore with a laterally extending production flow outlet. A tree cap having an axially extending flow passage and a laterally extending production flow outlet lands within the bore of the spool. Upper and lower seals on the tree cap seal between the tree cap and the bore of the spool above and below the production flow outlet of the spool. An isolation tube on a lower end of the tree cap sealingly engages the production flow passage of the tubing hanger. The tree cap may be ran with the spool as an assembly and retrieved from the spool for workover operations.

U.S. Pat. No. 8,794,334 B2

Description copied from http://www.google.com.ve/patents/US8794334

A system, in certain embodiments, includes a subsea tree and a tubing spool including a longitudinal bore configured to receive a tubing hanger. The tubing spool also includes a lateral flow passage extending from the longitudinal bore and configured to transfer product to the subsea tree. The subsea tree includes multiple valves each coupled to a structure positioned radially outward from the tubing spool such that the subsea tree does not block a subsea intervention connection or blowout preventer (BOP) access to the longitudinal bore.

Remaining Drawbacks of the Flexible Solutions Some of the solutions that offer independent retrieval of the XT and TH have the TH installed in a spool, which is installed on top of the wellhead before installing the TH in that spool. That process requires two trips of the BOP to complete the well. This is in opposition to the recent trend in the subsea petroleum industry, which prioritizes vertical XTs that require only one BOP trip for completing the well. That additional BOP-cost reduces the advantage of operational flexibility.

A XT that will offer an operational flexibility without scarifying the 'single-POB-trip' principle will appeal much more to the oil companies.

The aforesaid solutions, which offer independent retrieval of the XT and TH, require a costly R&D—and approval for their new components, so as to meet the rigorous industry requirements. A XT that will offer operational flexibility while using existing proven components will increase its chance to move from the drawing table to reality.

SUMMARY OF THE INVENTION

Subsea Wellhead System with Flexible Operation

An Innovation Principle in Accordance with Certain Embodiments of the Invention The invented flexible wellhead system is based on existing designs of XT, wellhead and TH, but applies modifications that eliminate the vertical linear dependency between the XT and the TH. That is achieved by breaking the direct connection between the TH and the XT, and instead leading the production-flow through a bypassing flow-block that runs outside the TH and XT and bridges between them. By breaking the direct connection between the TH and the XT, it is possible to install and retrieve them independently of each other.

The descriptions below refer to the embodiments of original claims 1 thru 4. Original claims 5 thru 8 cover additional configurations.

The flexible wellhead system allows retrieval and re-running of either the subsea XT or the TH independently of each other, thereby constituting a significant saving in operating expenses (OPEX). Over a subsea well's lifetime, the saving in OPEX is estimated to be at least 10 million $. The innovation is achieved through the modular concept, which arranges minimally-modified existing components in a new way, thus requiring little re-design and approval of components.

The operational flexibility is achieved by breaking the vertical-linear-dependency between the XT and TH, which in conventional XT-systems locks them in a rigid order over each other.

The key component of the invention is a tubing-hanger block, which houses the TH. A flow-block is integrated in the TH-block, and together they facilitate the bypassing function that breaks the direct connection and dependency between the TH and the XT.

Breaking the dependency between the XT and the TH is achieved by a dual innovation:

1. According to claims 1, 2 and 9, the production flow is diverted from the TH to a bypassing flow-block, which runs parallel to the TH-block, and leads the flow into the XT. Thanks to this bypass, the production flow occurs without a direct contact between the TH and the XT.
2. According to claims 3 and 9, the tubing hanger (TH) is divided into two parts, wherein the upper part a tubing-hanger extension—provides the hydraulic- and electronic connection between the XT and the TH.

Thanks to this removable tubing-hanger extension, the hydraulic and electronic connections occur without a direct contact between the XT and the TH.

All the barriers (valves, connectors and plugs) are either identical to existing barriers that are used in prior-art's wellhead systems, or based on proven design and materials. That provides leakage safety with minimum R&D cost.

This invention of a flexible wellhead system contains several configurations, which share the same innovative principle.

The configuration that is represented by claims 4 and 10, maintains the 'single-BOP-trip' principal, requiring only one BOP trip for completing the subsea well.

Except for the configuration covered by claims 6 and 12, all components that are subject to wear are independently retrievable, as part of either the Christmas tree or TH. The Christmas tree and the TH can be installed or retrieved without having to retrieve the other part beforehand.

PART NUMBERS INDEX

The numbers in the table below are used to identify the components on the illustrations.

| | |
|---|---|
| 1. | TH-block |
| 2. | TH-block's connection-hub |
| 3. | TH-block's longitudinal bore |
| 4. | Tubing hanger (TH) |
| 5. | TH-block's lateral production bore |
| 6. | TH-block's lateral annulus bore |
| 7. | TH's lateral production bore |
| 8. | TH's lateral annulus bore |
| 9. | Flow-block |
| 10. | Flow-block's lateral production bore |
| 11. | Flow-block's lateral annulus bore |
| 12. | Flow-block's vertical production bore |
| 13. | Flow-block's vertical annulus bore |
| 14. | Flow-block's flow connection-hub |
| 15. | XT's production flow-loop |
| 16. | XT's annulus flow-loop |
| 17. | Christmas tree (XT) |
| 18. | TH's lower vertical production bore |
| 19. | TH's lower vertical annulus bore |
| 20. | Wireline plugs in lower position |
| 21. | Wireline plugs in upper position |
| 22. | TH's upper vertical production bore |
| 23. | TH's upper vertical annulus bore |
| 24. | TH's coupler plate |
| 25. | TH's hyd. and el. couplers |
| 26. | TH's orientation slot |
| 27. | Tubing-hanger extension (TH-extension) |
| 28. | TH-extension flange |
| 29. | TH-extension flange's coupler-plate |
| 30. | TH-extension flange's hyd. and el. couplers |
| 31. | Hybrid Penetrator (HP) |
| 32. | TH-extension lower coupler-plate |
| 33. | TH-extension lower hyd. and el. couplers |
| 34. | Hyd.- and el. Lines inside the TH-extension |
| 35. | Orientation bracket on the TH-extension |
| 36. | TH-extension production access bore |
| 37. | TH-extension annulus access bore |

-continued

| | |
|---|---|
| 38. | Wellhead connector on XT |
| 39. | Flow connector |
| 40. | Production master valve (PMV) |
| 41. | Annulus master valve (AMV) |
| 42. | XT's re-entry hub |
| 43. | Flow-block's pressure cap |
| 44. | Auxiliary wellhead connector on TH-block |
| 45. | Wellhead flange |
| 46. | Production primary valve (PPV) |
| 47. | Annulus primary valve (APV) |
| 48. | Tubing hanger's sealing flanges |
| 49. | Prior-art's horizontal tubing hanger |
| 50. | Horizontal TH's lateral production bore |
| 51. | Annulus cavity in TH-block |
| 52. | Production flow-block |
| 53. | Annulus flow-block |
| 54. | Production flow-block connection-hub |
| 55. | Annulus flow-block connection-hub |
| 56. | Production flow connector |
| 57. | Annulus flow connector |
| 58. | Horizontal TH's vertical production bore |
| 59. | Christmas tree without interface to HP and TH-extension |
| 60. | Longitudinal bore inside the XT |

BRIEF DESCRIPTION OF THE DRAWINGS

FIG. 1A: Flow-Block's Pressure Cap

FIG. 3A: Stack-Up of Christmas Tree on TH-Block, Showing Tubing Hanger

FIG. 3B: Tubing Hanger with Tubing-Hanger Extension

FIG. 3C: Tubing-Hanger Extension

FIG. 4A: Tubing Hanger General View

FIG. 4B: Tubing Hanger with Couplers Shown

FIG. 5A: Tubing-Hanger Extension General View

FIG. 5B: Tubing-Hanger Extension with Hydraulic and Electric Lines Shown

DETAILED DESCRIPTION OF THE EMBODIMENTS

In the following description, numbers in brackets refer to the components as shown in the illustrations.

For Overview of the Illustration, see page 11 above.

TH-Block in Details

Figure 1:
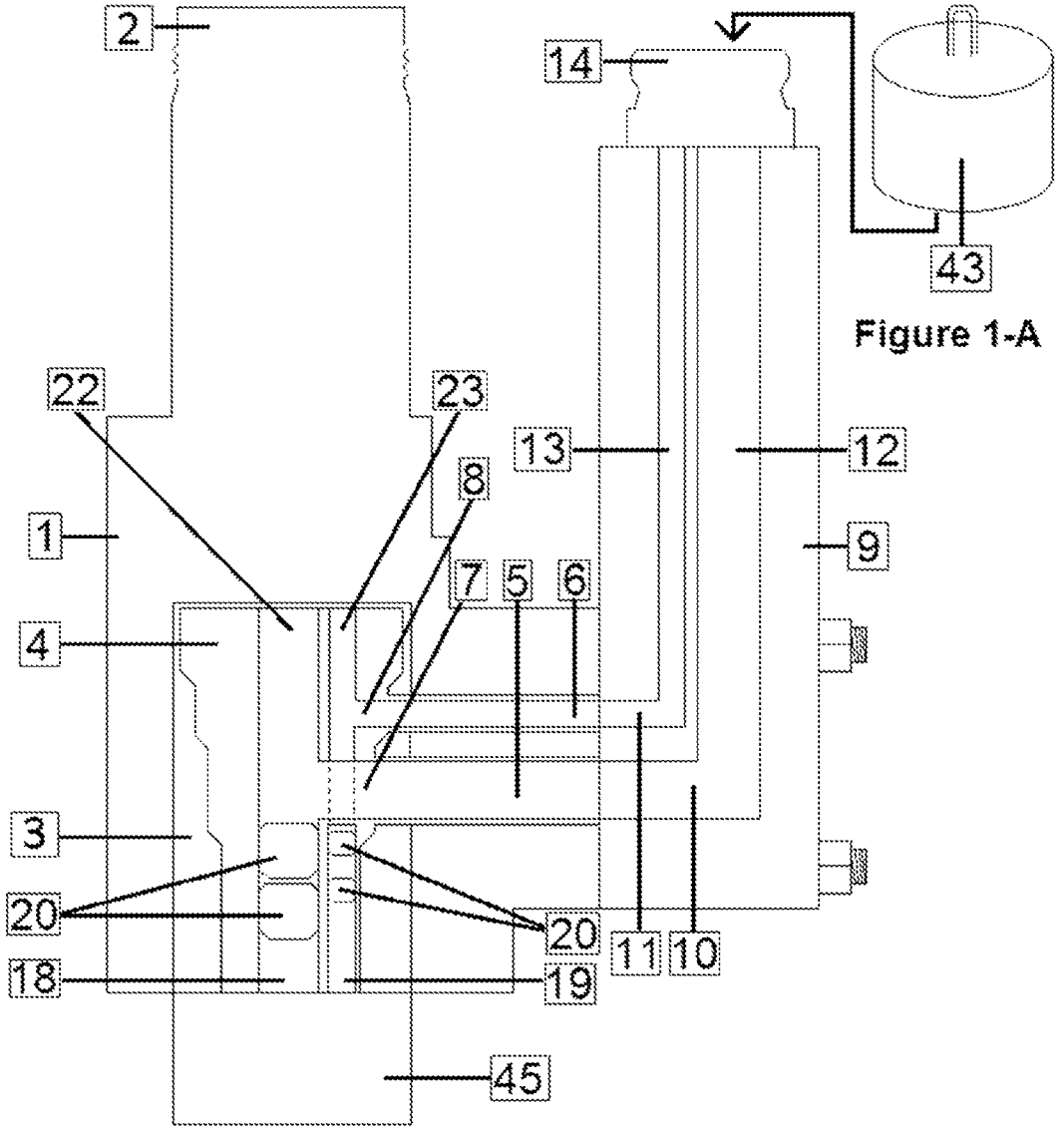
FIG. 1: TH-Block Integrated in Wellhead, with Tubing Hanger
Figure 2:
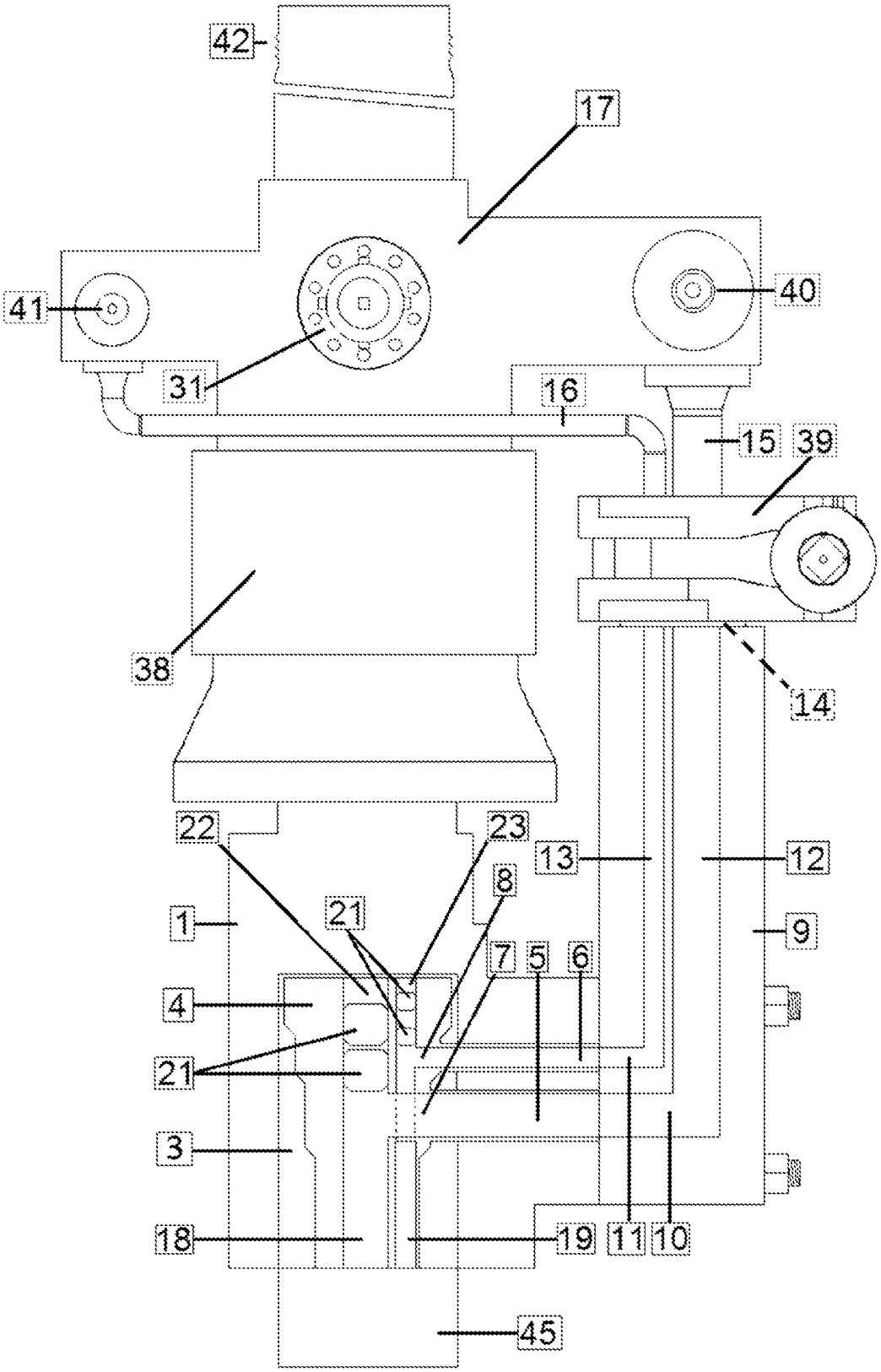
FIG. 2: Stack-Up of Christmas Tree on TH-Block Integrated in Wellhead

See FIG. 1; FIG. 1A; FIG. 2.

The TH-block [1] has at its top a connection-hub [2] of 18¾ inch (476 mm), which is similar to the connection-hubs on prior-art's wellheads.

The longitudinal bore [3] of the TH-block is shaped to host the TH [4],

The TH-block has lateral bores for production [5], and annulus [6], which interface the TH's corresponding lateral bores production [7] and annulus [8]. Through these bores, the petroleum production flows out and the annulus is accessed.

A flow-block [9] is integrated in the TH-block [1] and constitutes part of the TH-block, wherein:

- The lateral bores for production [5] and annulus [6] in the TH-block [1] interface corresponding lateral bores for production [10] and annulus [11] in the flow-block [9].
- The flow-block [9] directs the production- and annulus bores into vertical corresponding bores for production [12] and annulus [13], parallel to the longitudinal bore [3] of the TH-block.
- A flow connection-hub [14] at the upper end of the flow-block [9] functions as an interface between the flow-block's vertical bores—production [12]- and annulus [13]—and the flow-loops—production [15] and annulus [16]—on the XT [17]. This connection is accomplished by the flow connector [39].
- A pressure cap [43] is installed on the flow-block's flow connection-hub [14] when the XT [17] is not installed on the TH-block [1].

Tubing Hanger in Details

See FIG. 1; FIG. 2; FIG. 4A; FIG. 4B.

The TH [4] of the flexible wellhead system is installed inside the TH-block [1], similarly to the TH in prior-art's horizontal XTs.

The TH [4] interfaces the well by vertical bores for production [18] and annulus [19], from which split the TH's lateral bores for production [7] and annulus [8].

While the TH in horizontal XTs has typically only one bore, for production, in this invention of flexible wellhead system the TH has an annulus bore [19, 23, 8] in addition to the production bore [18, 22, 7]. Leading the annulus through a bore in the TH makes it possible to isolate the annulus with wireline plugs [20], in the same way that the production bore is isolated. Such barriers are necessary when the XT [17] is not installed on the TH-block [1].

The lateral bores for production [7] and annulus [8] in the TH [4] interface the lateral bores for production [5] and annulus [6] in the TH-block [1], in the same way that the TH in horizontal XTs interfaces the lateral bore in the XT's MVB.

The top of the TH [4] features a coupler-plate [24] with hydraulic- and electronic couplers [25], providing hydraulic supply and electronic connection to the hydraulic- and electronic components down the well's hole.

A flange with orientation slot [26] at the top of the TH [4] serves) orient the tubing-hanger extension [27] on the TH [4].

Wireline plugs can isolate the TH in two arrangements:

1. Either wireline plugs in a lower position [20], in the TH's lower vertical bores for production [18] and annulus [19], below the TH's lateral bores for production [7] and annulus [8];
2. Or wireline plugs in an upper position [21], in the TH's upper vertical bores for production [22] and annulus [23], above the TH's lateral bores for production [7] and annulus [8].

Functions of the wireline plugs:

- When the wireline plugs are removed, it is possible to access the TH's vertical production bore [18, 22] for well-intervention, just as in any vertical- or horizontal XT.
- When the wireline plugs [20] are installed below the TH's lateral bores [7, 8], they effectively secure the well against leakage during the installation phase, and when the XT [17] is not installed on the TH-block [1].
- When the wirelines plugs [21] are installed above the TH's lateral bores [7, 8], they:
  - Permit the flow of production through the TH's lateral production bore [7] to the flow-block [9] and through the flow connection-hub [14] to the XT [17];
  - Permit access to the well's annulus from the XT [17] and through the flow connection-hub [14] and flow-block [9] to the TH's lateral annulus bore [8];
  - Secure against leakage to the environment from the TH's upper vertical bores for production [22] and annulus [23].

Tubing-Hanger Extension in Details

See FIG. 2; FIG. 3A; FIG. 3B; FIG. 3C; FIG. 4A; FIG. 4B; FIG. 5A; FIG. 5B.

The Tubing-hanger extension (TH-extension) [27] is installed inside the block of the XT [17].

The TH-extension [27] interfaces the XT [17] and TH [4], to provide hydraulic- and electronic connection between the XT [17] and the TH [4].

The TH-extension [27] is independently retrievable. Therefore:

- When the TH-extension [27] is removed, there is no direct contact between the XT [17] and TH [4], and that allows the independent installation and retrieval of the XT and TH.
- It is then possible to—
  - Either pull out the TH [4] through the XT [17] without removing the XT [17];
  - Or retrieve the XT [17] without removing the TH [4].

The TH-extension [27] features a flange [28], with an outer diameter corresponding to the inner diameter of the XT's re-entry hub [42], wherein:

- The outer dimension of the TH-extension's flange [28] is larger than that of the larger sealing flange [48] on the TH [4]. Correspondingly, the dimension of the longitudinal bore [60] of the XT [17] is larger than that of the TH [4]; that allows the TH [4] to pass through the XT [17] for installation or retrieval of the TH.
- The TH-extension's flange [28] features a coupler-plate [29] with hydraulic- and electronic couplers [30], which interface horizontally the hybrid penetrator [31], which is mounted on the XT [17].
- The interface between the TH-extension's couplers [30] and the hybrid penetrator [31] on the XT [17] is similar to that interface in prior-art's horizontal XTs, and the method of stroking the hybrid penetrator and mating the couplers is as with prior-art's horizontal XTs.

The TH-extension [27] features a lower coupler-plate [32] with hydraulic- and electronic couplers [33], which interface vertically the hydraulic-and-electronic-couplers [25] on the coupler-plate [24] at the top of the TH [4].

Hydraulic- and electronic lines [34] inside the TH-extension [27] connect the TH-extension flange's coupler-plate [29] to the TH-extension's lower coupler-plate [32].

An orientation bracket [35] on the lower part of the TH-extension [27] guides the TH-extension into a corresponding orientation slot [26] on the TH [4], to ensure correct orientation of the TH-extension [27] and the TH [4].

This ensures correct mating between the TH-extension's lower couplers [33] and the TH's couplers [25].

The TH-extension [27] features longitudinal access bores for production [36] and annulus [37], interfacing the upper vertical bores for production [22] and annulus [23] in the TH [4], wherein:

Through the access bores in the TH-extension [27], the wireline plugs [20, 21] can be installed in the TH and removed.

The TH-extension's production access bore [36] allows access to the production tubing, for well intervention through the TH [4].

The Connection Between the TH-Block and XT in Details

See FIG. 1; FIG. 2.

The XT [17] lands and locks onto the TH-block [1] by means of a wellhead connector [38], which is identical to the wellhead connectors in prior-art's horizontal- and vertical XTs.

The flow connector [39] on the XT [17] lands and locks onto the flow connection-hub [14] at the upper end of the flow-block [9], which is integrated in the TH-block [1].

The XT's wellhead connector [38] and flow connector [39] land simultaneously on the TH-block's connection-hub [2] and the flow-block's flow connection-hub [14].

Both connectors [38, 39] are operated hydraulically through the XT's running tool, and both connectors have a mechanical release option.

The production main flow loop [15] and annulus main flow-loop [16] lead from the flow connection-hub [14] on the flow-block [9] to the production master valve [40] and the annulus master valve [41] on the XT [17].

From the production master valve [40] and annulus master valve [41], all the remaining components of the flexible wellhead system are similar to the prior-art's horizontal- and vertical XTs, including all the main features such as flow loops, wing valves, flow module and control module. These components are not affected by this invention, and are not discussed here.

Modified Configurations of the Invention

The following modifications maintain the principal innovation of this invention, which eliminates the direct connection between the tubing hanger (TH) and Christmas tree (XT), and instead leads the production-flow through a bypassing flow-block that runs outside the TH and XT, and bridges between them.

Thereby they maintain the advantage of the invention, which is the possibility of independent installation and retrieval of the TH and XT.

Intermediary TH-Block with Auxiliary Wellhead Connector

Figure 6:
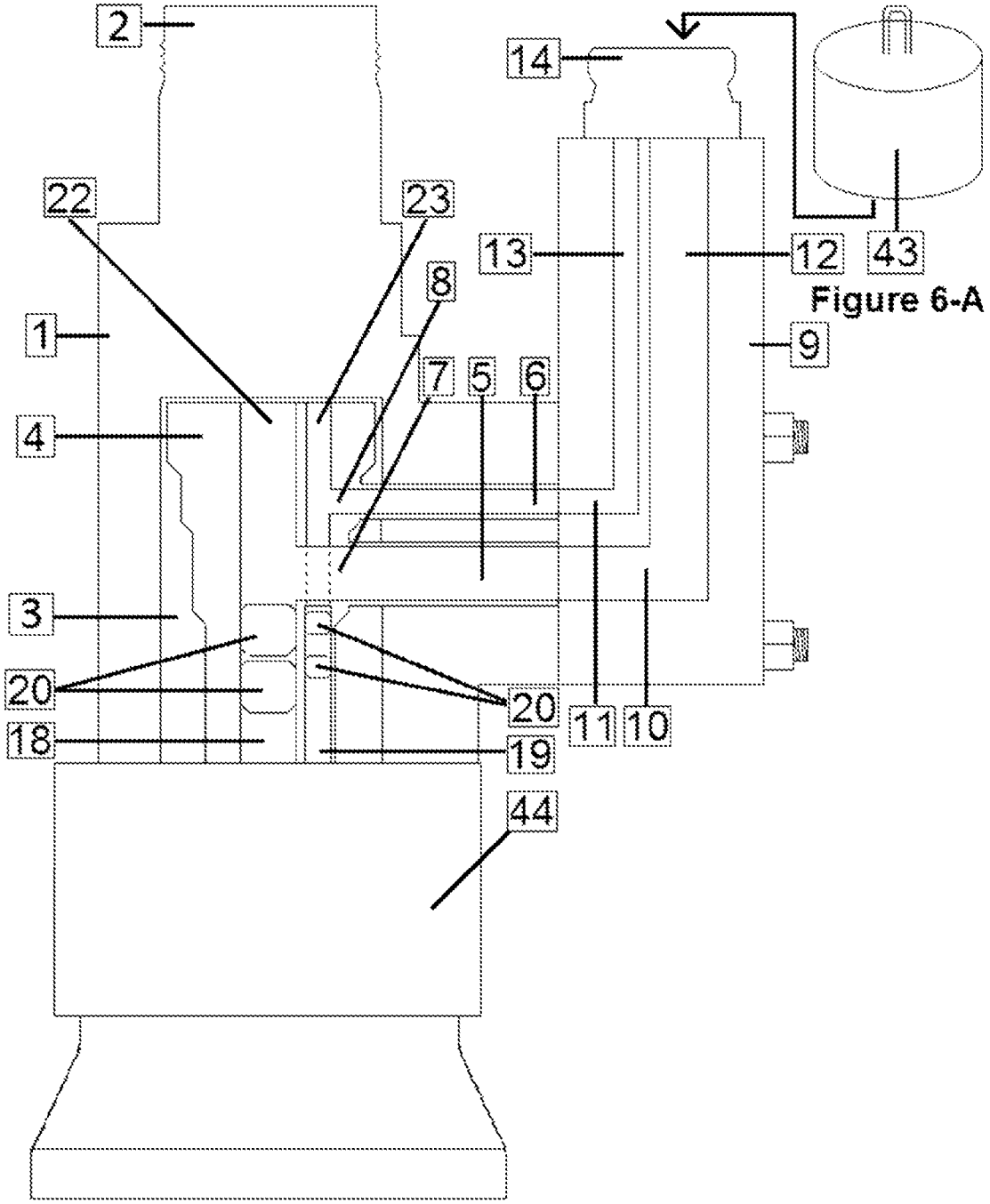
FIG. 6: Intermediary TH-Block with Auxiliary Wellhead Connector
Figure 7:
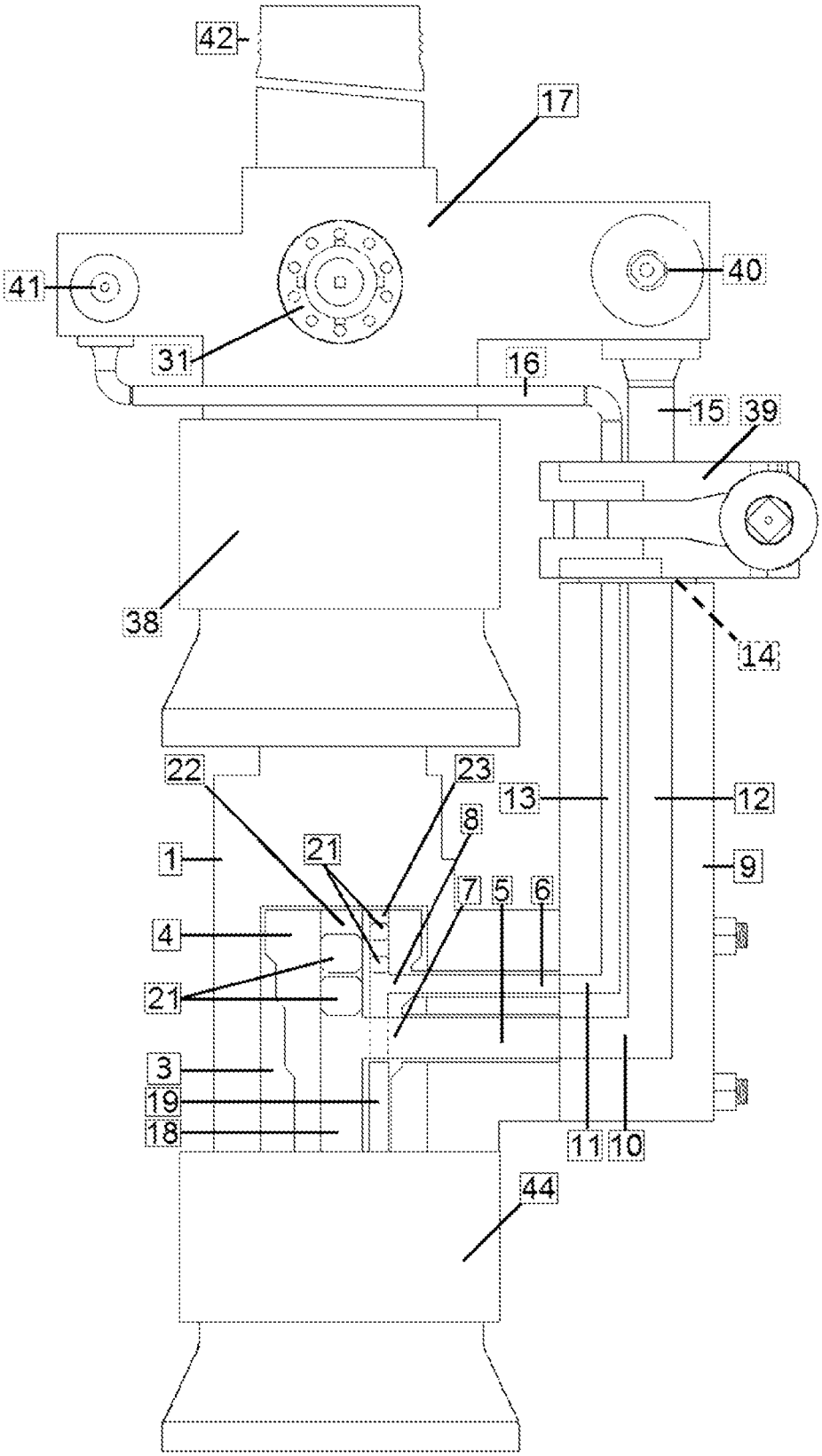
FIG. 7: Stack-Up of Christmas Tree on Intermediary TH-Block with Auxiliary Wellhead Connector

See FIG. 6; FIG. 7.

This configuration features a modification wherein the TH-block [1] is not integrated in the wellhead, but instead functions as an intermediary connection-spool between a prior-art's wellhead and the XT [17]. For this purpose, an auxiliary wellhead connector [44] is integrated at the bottom of the TH-block [1], and serves to install and lock the TH-block [1] onto the prior-art's wellhead. Besides this modification, all other features of the invention remain the same.

Figure 8:
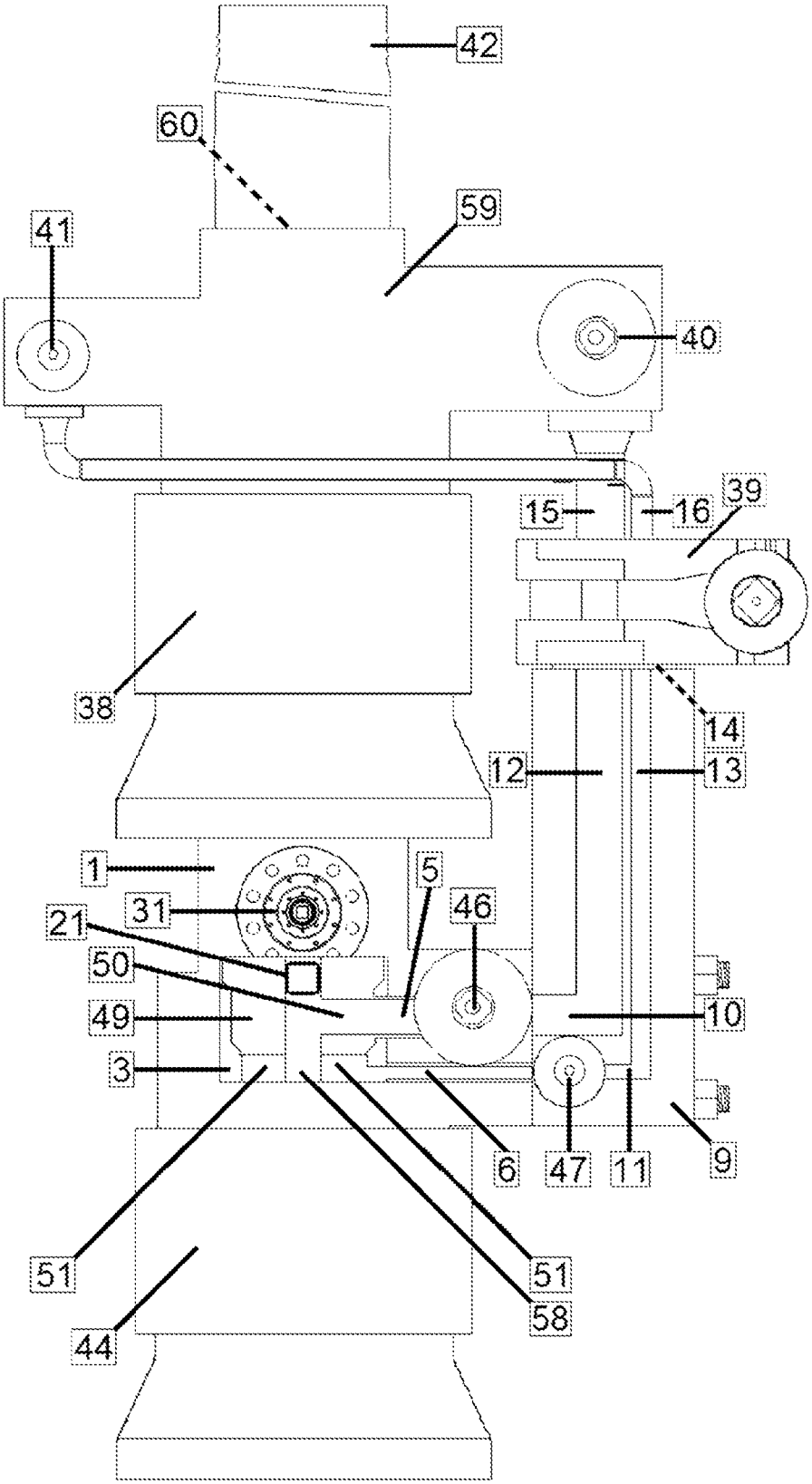
FIG. 8: Stack-Up of Christmas Tree on Intermediary TH-Block with Valves and Hybrid Penetrator In the following illustrations, the same configurations that are shown in the previous illustrations are shown with a single modification: instead of one flow-block, there are two flow blocks.

Prior-Art's Tubing Hanger and Hybrid Penetrator Installed in the Intermediary TH-Block See FIG. 8.

In this configuration, the TH-block is shaped to host a prior-art's horizontal tubing hanger [49], as well as hybrid penetrator [31] and primary valves for production [46] and annulus [47].

The invented TH [4] and TH-extension [27] are not used in this configuration.

All other features of the invention remain the same.

Also in this configuration, the TH-block [1] functions as an intermediary connection-spool between a prior-art's wellhead and the XT [17]. For this purpose, an auxiliary wellhead connector [44] is integrated at the bottom of the TH-block [1], and serves to install and lock the TH-block [1] onto the prior-art's wellhead.

Separate Flow Blocks for Production and Annulus

Figure 9:
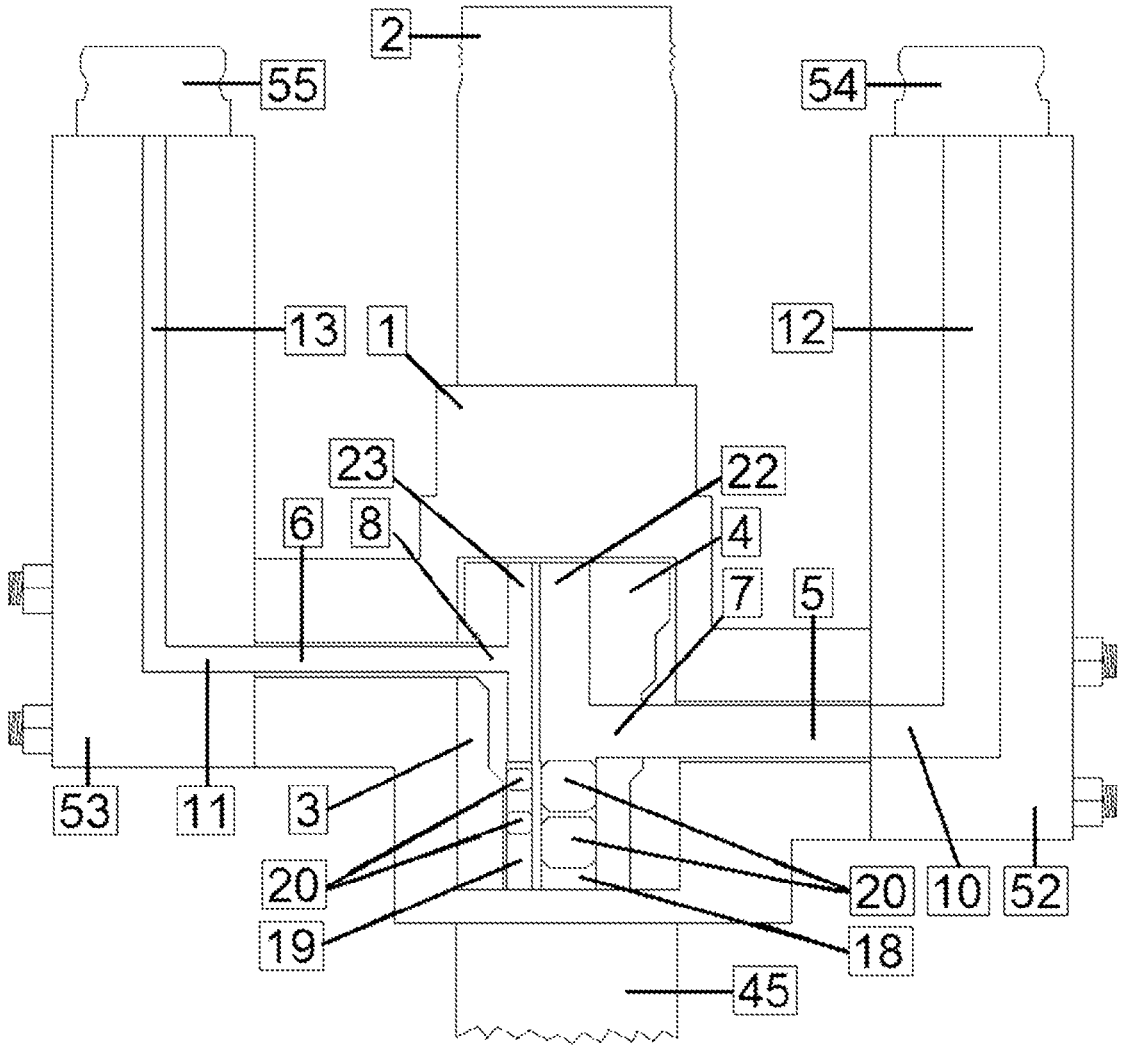
FIG. 9: TH-Block Integrated in Wellhead, with Tubing Hanger, with Two Flow Blocks
Figure 10:
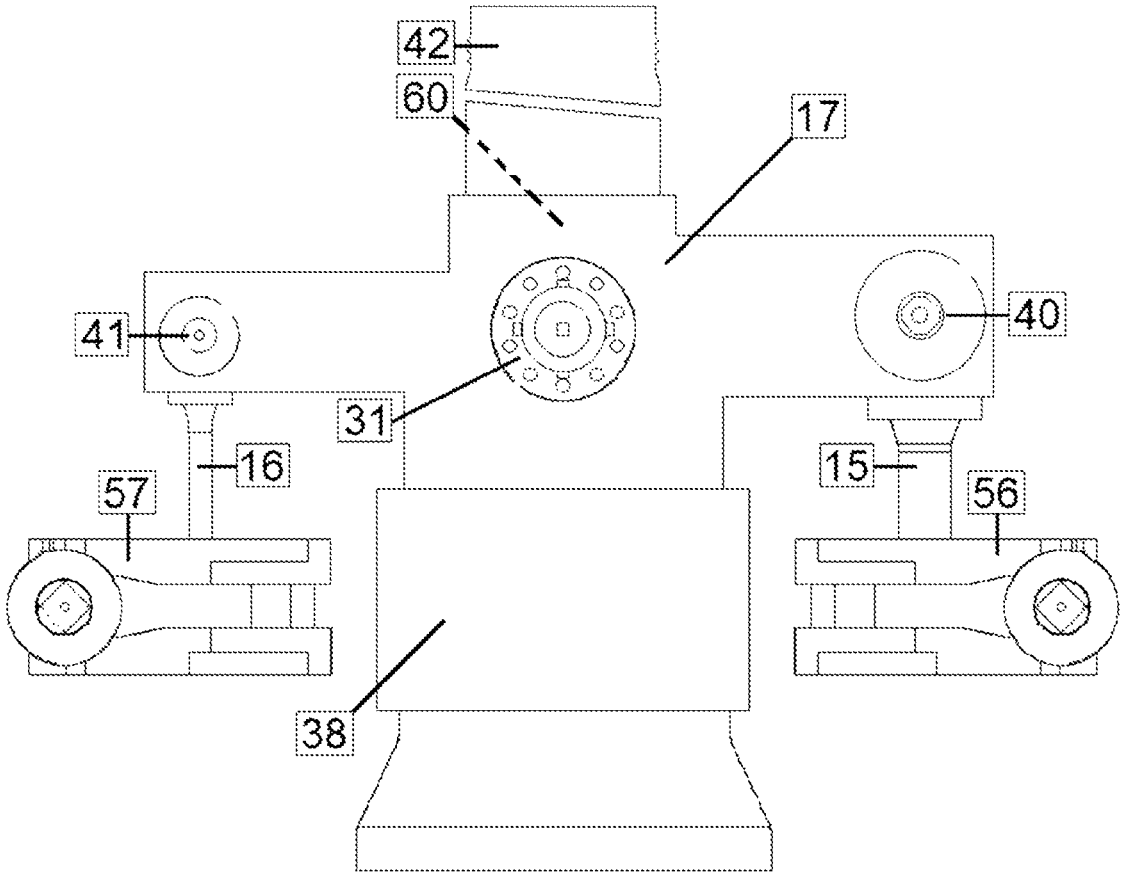
FIG. 10: Christmas Tree with Two Flow Connectors
Figure 11:
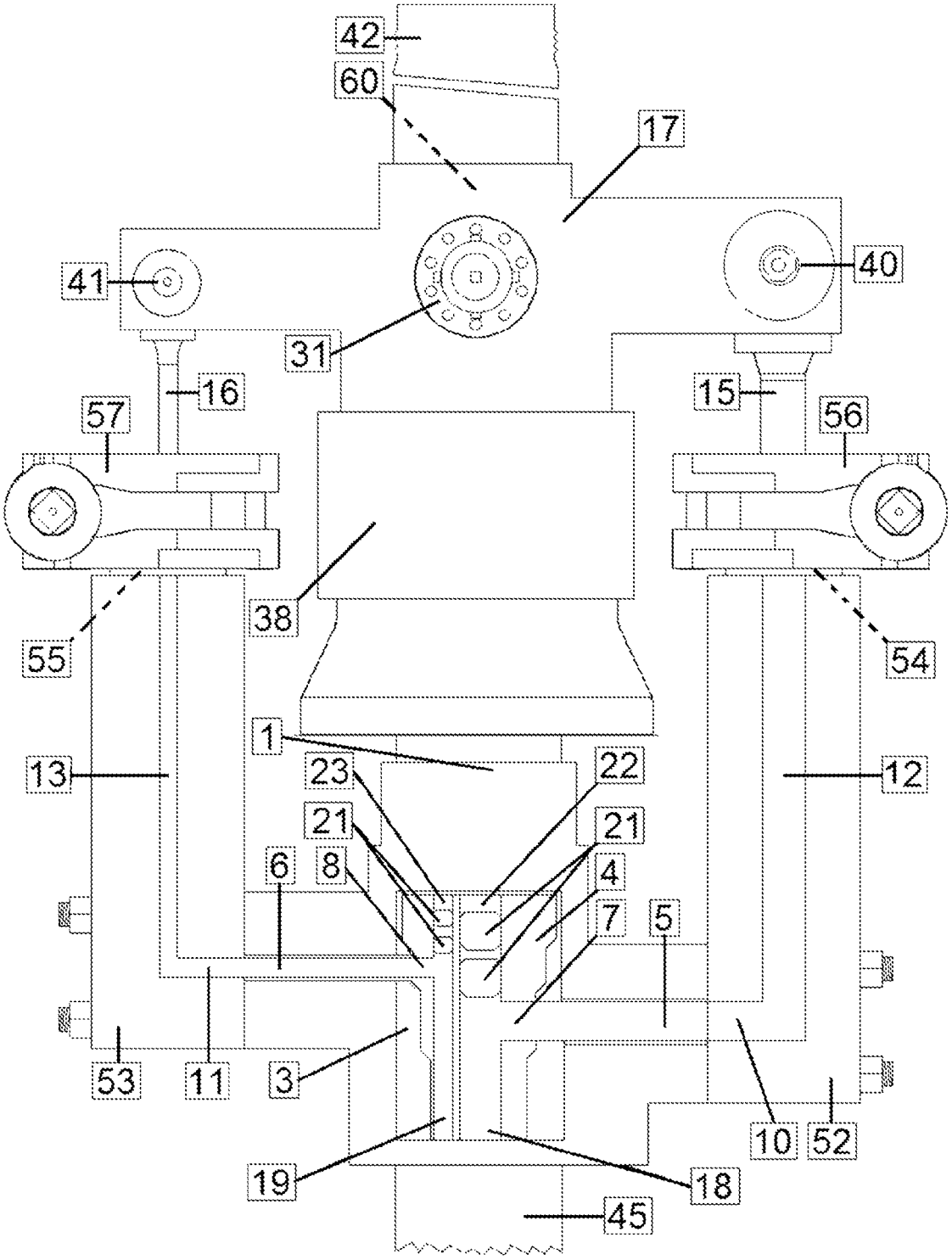
FIG. 11: Stack-Up of Christmas Tree on TH-Block Integrated in Wellhead, with Two Flow Blocks
Figure 12:
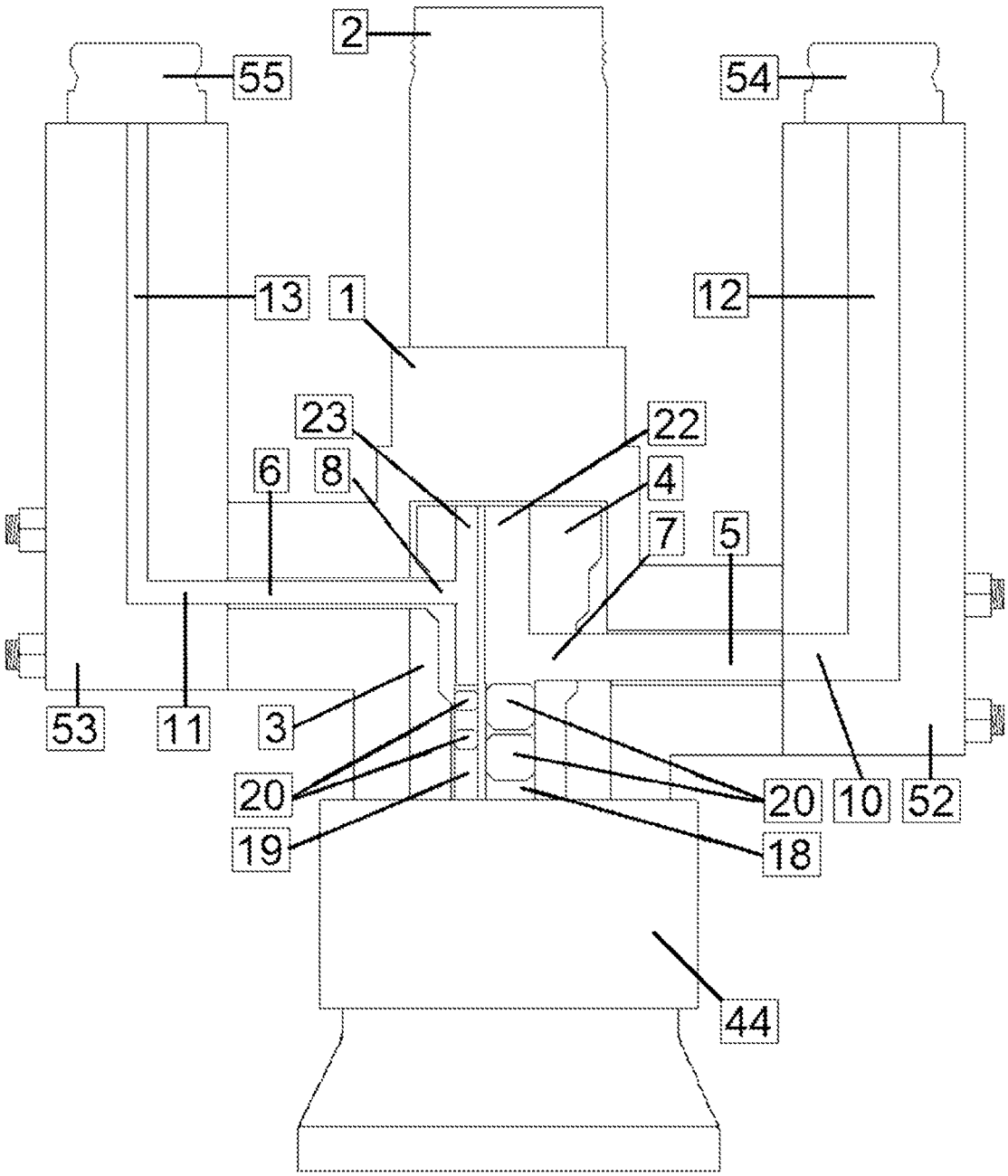
FIG. 12: Intermediary TH-Block with Auxiliary Wellhead Connector, with Two Flow Blocks
Figure 13:
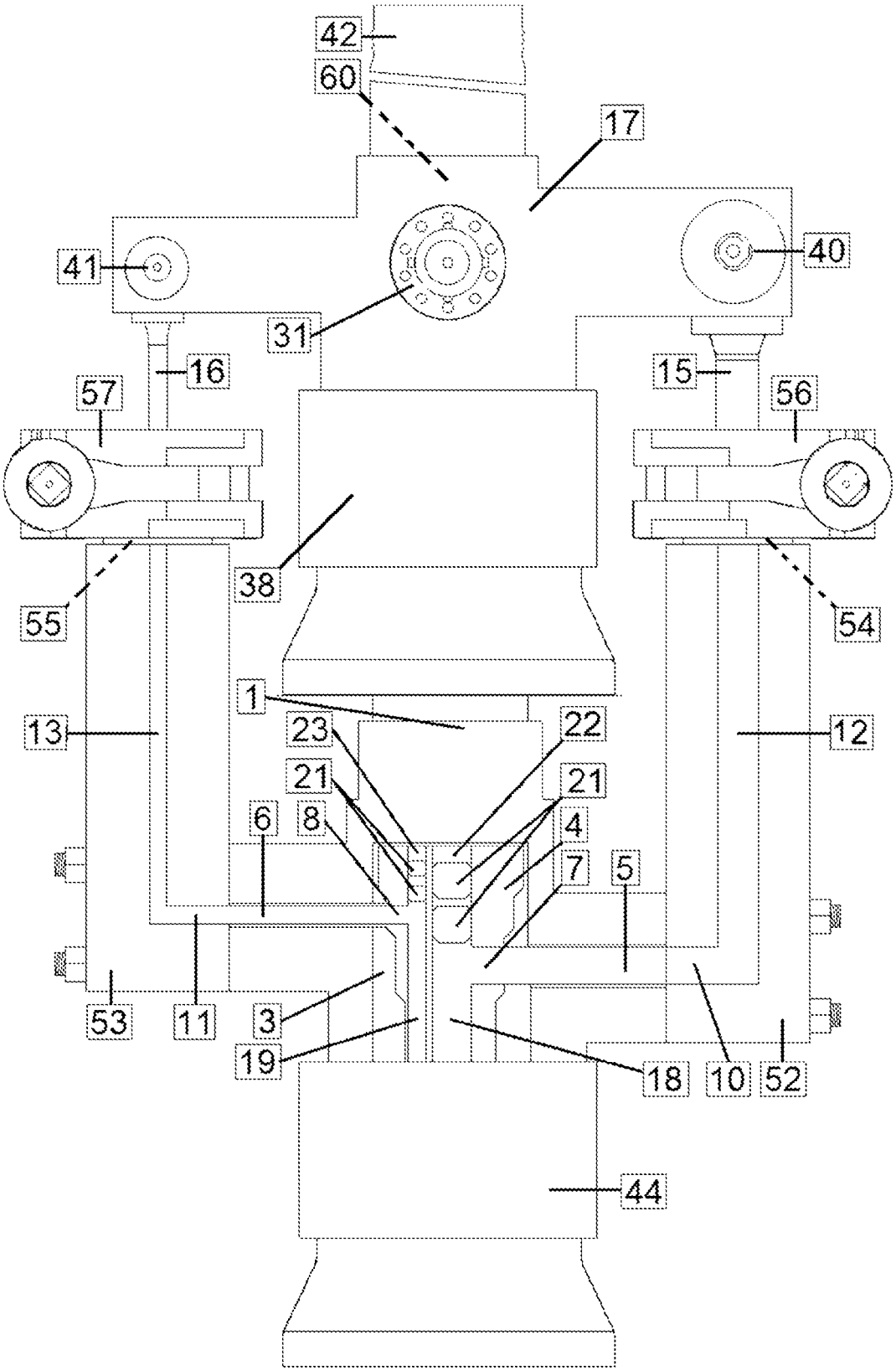
FIG. 13: Stack-Up of Christmas Tree on Intermediary TH-Block with Auxiliary Wellhead Connector, with Two Flow Blocks
Figure 14:
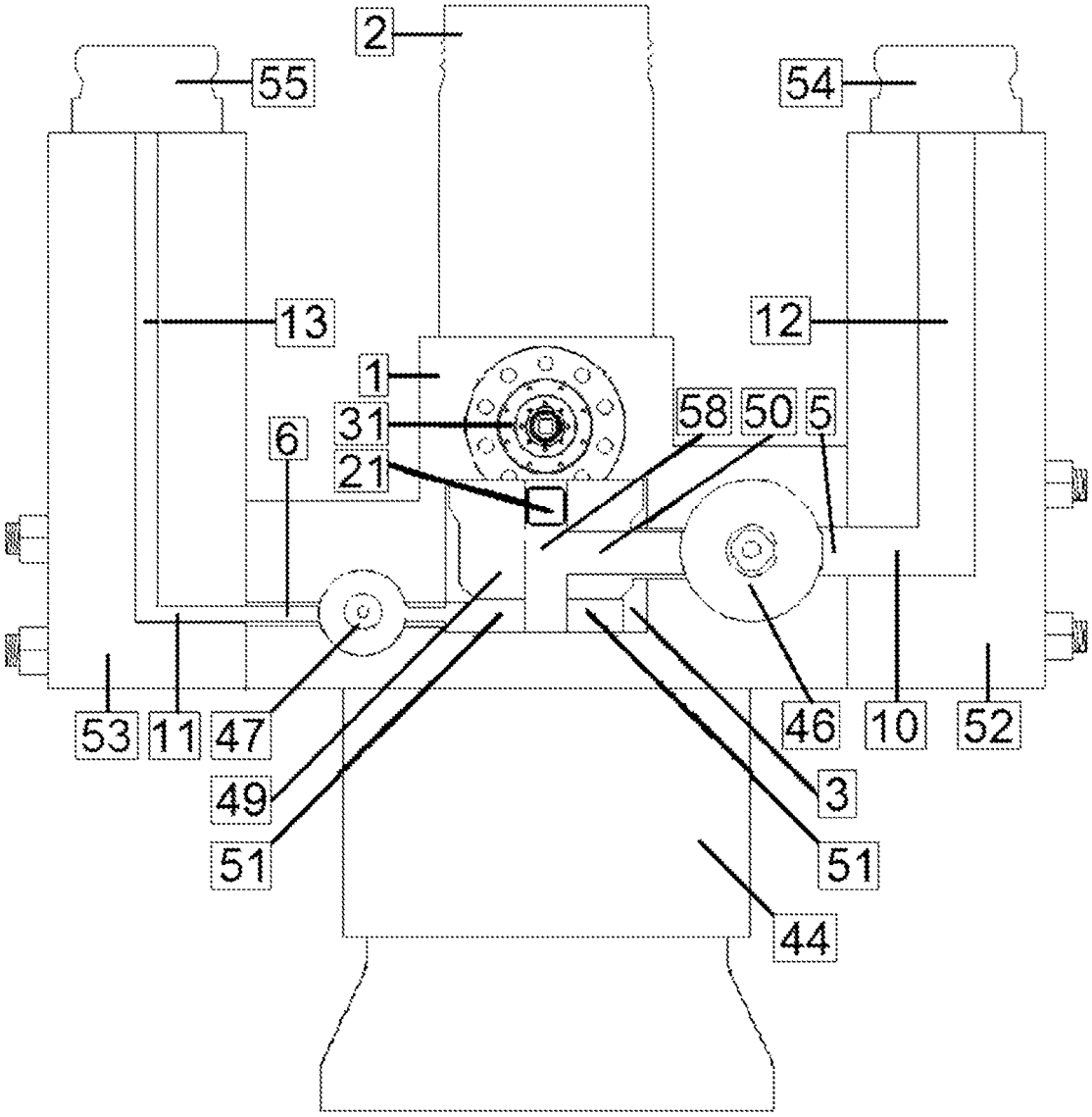
FIG. 14: Intermediary TH-Block with Valves and Hybrid Penetrator, with Two Flow Blocks
Figure 15:
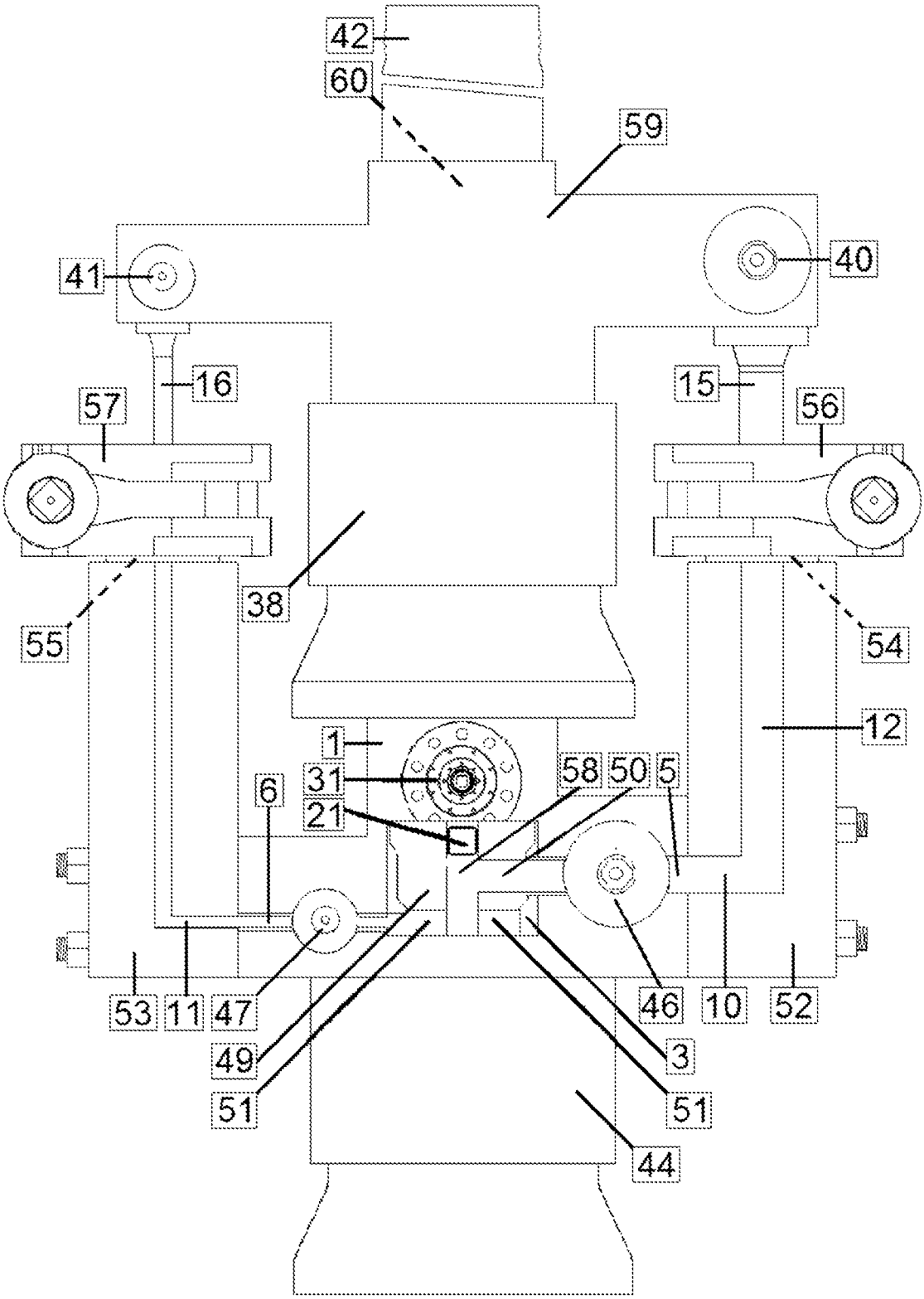
FIG. 15: Stack-Up of Christmas Tree on Intermediary TH-Block with Valves and Hybrid Penetrator, with Two Flow Blocks

NOTE: this modification applies to all the configurations that have been described before. See FIG. 9; FIG. 10; FIG. 11; FIG. 12; FIG. 13; FIG. 14; FIG. 15. Instead of leading the production and annulus through a joint flow block [9], there are two separate flow blocks for production [52] and annulus [53], Consequently, instead of a joint flow connector [39], there are two separate flow connectors for production [54] and annulus [55]. All other features of the invention remain the same.

Installation Sequence of the Subsea Wellhead System, in Details

NOTE: this applies to claims 1 thru 4, where the TH-block [1] is integrated with the wellhead [45]. See FIG. 1; FIG. 2; FIG. 4B; FIG. 5A.

1. The pressure cap [43] is installed on the flow connection-hub [14], at the top of the flow-block [9].
2. The block of combined wellhead [45] and TH-block [1] with integrated flow-block [9] is installed subsea, similarly to installation of prior-art's wellheads.
3. The blowout preventer (BOP) lands and locks onto the TH-block's connection-hub [2].
4. The last casings are installed through the BOP, similarly to installing of prior-art's casings.
5. Drilling to the petroleum formation is done through the BOP.
6. Before running the TH [4] subsea, the wireline plugs are installed in their lower position [20] in the TH's lower vertical bores for production [18] and annulus [19], below the TH's horizontal lateral bores for production [7] and annulus [8].
7. Using the TH's running tool, the tubing pipes and TH [4] are run subsea through the BOP and enter the TH-block [1].
8. The TH [4] is oriented correctly inside the TH-block by guide brackets and the TH's running tool.
9. The TH [4] lands and locks inside the TH-block [1].
10. The BOP is removed.
11. The pressure cap [43] is removed from the flow connection-hub [14], at top of the flow-block [9].
12. The XT [17] is run subsea by a running tool and lands on the TH-block as the XT's wellhead connector [38] and flow connector [39] orient and land simultaneously on the TH-block's connection-hub [2] and the flow-block's flow connection-hub [14].

13. The XT's wellhead connector [38] and flow-connector [39] lock to the TH-block's connection-hub [2] and the flow-block's flow connection-hub [14].
14. The XT's running tool is removed.
15. The work-over tool lands and locks onto the XT's re-entry hub [42].
16. Using a wireline-plugs' tool, the wireline plugs are removed from their lower position [20] to their upper position [21], in the TH's upper vertical bores for production [22] and annulus [23], above the TH's lateral bores for production [7] and annulus [8].
17. The work-over tool is retrieved from the XT [17].
18. Using the TH-extension' running tool, the TH-extension [27] is installed inside the XT [17].
    NOTE: Optionally, the TH-extension [27] can be installed inside the XT [17] before running the XT subsea. That will make this step (18) redundant and save work and time.
19. The TH-extension's hydraulic and electronic couplers [33] mate their corresponding TH's couplers [25].
    NOTE: If the TH-extension [27] had been installed inside the XT [17] before running the XT subsea, this step is redundant, since the hydraulic and electronic couplers have already mated during landing of the XT [17] onto the TH-block [1], according to step 12 above.
20. The TH-extension' running tool is removed.
    NOTE: If the TH-extension [27] was installed inside the XT [17] before running the XT subsea, this step is redundant.
21. Using a tree-cap running tool, the tree-cap lands and locks onto the XT's re-entry hub [42].
22. The hybrid penetrator [31] is stroked and mates the hydraulic- and electronic couplers [30] on the TH-extension flange's couplers-plate [29].
    NOTE: If the TH-extension [27] was installed inside the XT [17] before running the XT subsea, this step is redundant.
23. The remaining installation- and connection operations of the XT are as with prior-art's XTs.
24. The operation and production from the XT is as with prior-art's XTs.

Retrieval Sequence of the XT, in Details

NOTE: this applies to claims 1 thru 5.

See FIG. 1; FIG. 2; FIG. 6; FIG. 7.

1. Shutting the production and preparations for retrieval are performed as with prior-art's XTs.
2. Using a tree-cap running tool, the tree-cap is removed from the XT's re-entry hub [42].
3. The work-over tool runs and locks onto the XT's re-entry hub [42].
4. Using a wireline-plugs' tool, the wireline plugs are removed from their upper position [21] to their lower position [20] in the lower vertical bores for production [18] and annulus [19] in the TH [4], below the TH's lateral bores for production [7] and annulus [8].
5. The work-over tool is retrieved from the XT's re-entry hub [42].
6. The XT running tool lands and locks to the XT.
7. Using the XT's running tool, the wellhead connector [38] and flow connector [39] are opened, and the XT [17] is retrieved.
8. Optionally, using a tree-cap running tool, the tree-cap is installed on the TH-block's connection-hub [2], to secure the well.
9. Optionally, using a flow-block cap running tool, the flow-block's pressure cap [43] is installed on the flow connection-hub [14] at the top of the flow-block [9], to secure the well.

Pulling-Out Sequence of the TH with Tubing, in Details

NOTE: this applies to claims 1 thru 5.

See FIG. 2; FIG. 3A; FIG. 3B; FIG. 3C; FIG. 7.

1. Shutting the production and preparing the well for tubing retrieval are as with prior-art's XTs.
2. Using a tree-cap running tool, the tree-cap is removed from the XT [17].
3. Using an RON", the hybrid penetrator [31] is retracted from the hydraulic and electronic couplers [30] on the TH-extension's flange [28].
4. Using the TH-extension's running tool, the TH-extension [27] is retrieved from the XT [1].
5. The BOP lands and locks onto the XT's re-entry hub [42].
6. Using the TH's running tool, the TH [4] and the tubing are pulled out through the BOP, using the same procedures and methods as with prior-art's wellhead systems.
7. The well is made secured, using the BOP and the same methods as with prior-art's XTs.

The invention that is claimed is:

1. A subsea wellhead assembly, comprising a tubing-hanger block (TH-block) [1], comprising:

a connection-hub [2] at the top of the TH-block, and a vertical (longitudinal) bore [3], shaped to house and sustain a tubing hanger (TH) [4, 49]; and a horizontal (lateral) bore for the production flow [5]; and a horizontal (lateral) bore for accessing the annulus [6]; and a flow-block [9], which is integrated with the TH-block [1], wherein the flow-block's horizontal bores for production [10] and annulus [11] interface the horizontal production- and annulus bores [5, 6] in the TH-block, and direct their flow to vertical production- and annulus bores [12, 13], parallel to the TH-block's vertical (longitudinal) bore [3]; and a flow connection-hub [14] at the upper end of the flow-block [9];

and comprising a Christmas tree (XT) [17], comprising:

a longitudinal bore [60], which is shaped to fit and house the tubing-hanger extension (TH-extension) [27] and is configured to allow free through-passage of the TH [4], and a housing for a hybrid penetrator (HP) [31], which is mounted on the XT [17] so as to allow the HP [31] to mate a plurality of couplers [30] on the TH-extension [27] when the TH-extension [27] is installed inside the XT [17], and a production master valve (PMV) [40] and an annulus master valve (AMV) [41], and a production flow-loop [15] and an annulus flow-loop [16], to connect the PMV [40] and AMV [41] with the flow connector [39] on the XT [17], and a flow connector [39], to connect the XT [17] to the flow connection-hub [14] on the flow-block [9] of the TH-block [1].

2. A subsea wellhead assembly according to claim 1, comprising a tubing hanger (TH) [4], comprising:

lower vertical (longitudinal) bores for production [18] and for annulus [19], wherein wireline plugs [20] can be installed, to serve as barriers before the XT is installed, and upper vertical (longitudinal) bores for production [22] and annulus [23], wherein wireline plugs [21] can be installed, to serve as barriers after the XT [17] is installed, and horizontal (lateral) bores for production [7] and for annulus [8], which split from the TH's vertical bores for production [18, 22] and annulus [19, 23], and interface the horizontal (lateral) bores for production [5] and annulus [6] in the TH-block [1], and sealing flanges [48], which interface the TH-block's bore [3] and prevent leakage from the TH's horizontal bores [7, 8] towards the environment, and a coupler-plate [24], housing hydraulic- and electronic couplers [25] on the upper face of the TH [4], to interface vertically a plurality of corresponding couplers [33] on the lower coupler-plate [32] at the bottom of the TH-extension [27], and a flange with orientation slot [26] at the top of the TH [4], to orient the TH-extension [27] on the TH [4].

3. A subsea wellhead assembly according to claim 1, comprising a TH-extension [27], to provide hydraulic- and electronic connection between the XT [17] and the TH [4], comprising:

a flange [28], with an outer diameter slightly less than the inner diameter of the XT's re-entry hub [42], thus fitting inside the longitudinal bore [60] of the XT [17], and an upper coupler-plate [29], with hydraulic- and electronic couplers [30], which interface horizontally a hybrid penetrator [31], which is mounted on the XT [17], and a lower coupler-plate [32], with hydraulic- and electronic couplers [33], which interface vertically a plurality of hydraulic-and-electronic-couplers [25] at the top of the TH [4], and hydraulic- and electronic lines [34] inside the TH-extension [27], to connect the upper coupler-plate [29] to the lower coupler-plate [32], and an orientation bracket [35] on the lower part of the TH-extension [27], to guide the TH-extension [27] into an orientation slot [26] on the TH [4], so as to ensure correct mating between the hydraulic- and electronic couplers [33] on the TH-extension [27] and the hydraulic- and electronic couplers [25] on the TH [4], longitudinal access bores for production [36] and annulus [37], interfacing the upper vertical bores for production [22] and annulus [23] in the TH [4], through which a plurality of wireline plugs [20, 21] can be installed in the TH [4] or be removed, and the production tubing can be accessed through the TH [4], for well intervention.

4. A TH-block according to claim 1, wherein:

the TH-block [1] and a wellhead flange [45] are integrated as one combined block, and the combined block that comprises the TH-block [1] and the wellhead flange [45] is connected to the well's conductor housing and casings.

5. A TH-block according to claim 1, comprising an auxiliary wellhead connector [44] that is located and integrated at the bottom of the TH-block [1], for connecting the TH-block [1] to the wellhead [45].

6. A TH-block according to claim 1, comprising:

a longitudinal bore [3], shaped similarly to the bore of prior-art's horizontal XT, and a horizontal TH [49], which is installed inside the TH-block [1], and a hybrid penetrator [31], which is mounted on the side wall of the TH-block [1], and a horizontal (lateral) bore for production [5], which interfaces the horizontal (lateral) bore for production [50] in the TH [49], and a horizontal (lateral) bore for annulus [6], which interfaces the annulus cavity [51] in the TH-block [1], and a production primary valve (PPV) [46], which is installed on the lateral production bore [5] in the TH-block [1], to secure a well when the XT [59] is not installed, and an annulus primary valve (APV) [47], which is installed on the lateral annulus bore [6] in the TH-block [1], to secure the well when the XT [59] is not installed, and an auxiliary wellhead connector [44], which is located and integrated at the bottom of the TH-block [1], for connecting the TH-block [1] to the wellhead [45].

7. A Christmas tree (XT) [59] according to claim 6 comprising:

a longitudinal bore [60] in a straight continuation of a re-entry hub [42] and with the same inner dimension as that of the re-entry hub [42], and a production master valve (PMV) [40] and annulus master valve (AMV) [41], and a production flow-loop [15] and an annulus flow-loop [16], to connect the PMV [40] and AMV [41] with the flow connector [39] on the XT [59], and a flow connector [39], to connect the XT [59] to the flow connection-hub [14] on the flow-block [9] of the TH-block [1].

8. A subsea wellhead assembly according to claim 1, with one modification wherein:

the combined flow-block [9] for production and annulus (which is featured in all the configurations listed in any of the previous claims) is replaced by two separate flow-blocks for production [52] and annulus [53], and each flow block [52, 53] has its own flow connection hub at its top [54, 55], and the XT [17, 59] has separate flow connectors for production [56] and annulus [57].

9. A method for configuring a subsea wellhead assembly, comprising of a TH-block [1] with flow block [9, 52,53], XT [17], TH [4] and TH-extension [27], wherein:

the TH [4] is installed inside the TH-block [1], and the XT [17] is installed and locks onto the TH-block [1] by means of a wellhead connector [38] and flow connector [39, 56, 57], and a plurality of horizontal (lateral) bores for production [7] and annulus [8] in the TH [4] are connected through horizontal (lateral) bores for production [5] and annulus [6] in the TH-block [1] to a flow-block [9, 52,53] that is integrated in the TH-block [1], and inside that flow-block [9, 52,53] the production and annulus are directed upward in vertical bores [12, 13], parallel to the vertical (longitudinal) bore [3] of the TH-block [1], and continue through a flow connection-hub [14, 54, 55] at the top of the flow-block [9, 52,53] and through a flow connector [39, 56, 57] into the XT's main flow-loops for production [15] and annulus [16], which lead into the XT's production master valve [40] and annulus master valve [41], and the TH-extension [27] is installed inside the XT [17] and the TH-extension's lower end extends into the TH-block [1] below, to interface the TH [4] that is installed inside the TH-block [1], thus providing hydraulic- and electronic connections from the XT [17] to the TH [4], and when the TH-extension [27] is removed from the XT [17], the TH [4] with the tubing pipes can be installed and retrieved through the XT [17], without having to retrieve the XT beforehand, and when the XT's wellhead connector [38] and flow-connector [39, 56, 57] are open, the XT [17] can be installed and retrieved, without having to retrieve the TH [4] with the tubing pipes beforehand.

10. A method for configuring a subsea wellhead assembly of a well according to claim 9, comprising a wellhead flange [45], TH-block [1] with flow block [9, 52,53], wherein:

an integrated block of wellhead flange [45] and TH-block [1] with flow-block [9, 52, 53] is run and installed subsea as one unit, and a blowout preventer (BOP) is installed onto the TH-block [1], and installing the well's last casings is completed through the BOP and through the TH-block [1], and after completing the well's last casings, the TH [4] is installed in the TH-block [1] through the BOP, thus requiring only one BOP trip.

11. A method for configuring a subsea wellhead assembly according to claim 9, comprising a TH-block [1] with flow block [9, 52,53], Christmas tree (XT) [17], auxiliary wellhead connector [44] and a wellhead [45], wherein:

the TH-block [1] is installed and locks onto the wellhead [45], by means of the auxiliary wellhead connector [44], and the TH-block [1] functions as an intermediary connection between the wellhead [45] and the XT [17], which is installed and locks onto the TH-block [1] by means of the XT's wellhead connector [38] and flow connector [39, 56, 57].

12. A method for configuring a subsea wellhead assembly according to claim 9, comprising a TH-block [1] with flow block [9, 52,53], XT [59], auxiliary wellhead connector [44], hybrid penetrator [31], a horizontal TH [49] and a wellhead [45], wherein:

the TH-block [1] is installed and locks onto the wellhead [45], by means of the auxiliary wellhead connector [44], and the horizontal TH [49] is installed inside the TH-block [1], and a hybrid penetrator [31] that is mounted on the TH-block [1] interfaces the TH [49] that is installed inside the TH-block [1], and the horizontal (lateral) bore for production [50] in the TH [49] is connected through horizontal (lateral) bore for production [5] in the TH-block [1] to a flow-block [9, 52] that is integrated in the TH-block [1], and an annulus cavity [51] in the TH-block [1] is interfaced by the horizontal (lateral) bore for annulus [6] in the TH-block [1] and continues into to the flow-block [9, 53] that is integrated in the TH-block [1], and inside the flow-block [9, 52,53] the production and annulus are directed upward in vertical bores [12, 13], parallel to the vertical (longitudinal) bore [3] of the TH-block [1], and continue through a flow connection-hub [14, 54, 55] at the top of the flow-block [9, 52,53] and further through a flow connector [39, 56, 57] into the XT's main flow-loops for production [15] and annulus [16], which lead into the production master valve [40] and the annulus master valve [41] on the XT [59], and the PPV [46] and APV [47] provide barriers towards the environment when the XT [59] is not installed on the TH-block [1], and the TH-block [1] functions as an intermediary connection between the wellhead [45] and the XT [59], which is installed and locks onto the TH-block [1] by means of the XT wellhead connector [38] and flow connector [39, 56, 57], and when the HP [31] is retracted and disconnected from the horizontal TH [49], the horizontal TH [49] with the tubing pipes can be installed and retrieved through the XT [59], without having to retrieve the XT [59] beforehand, and when the XT's wellhead connector [38] and flow-connector [39, 56, 57] are open, the XT [59] can be installed and retrieved without having to retrieve the horizontal TH [49] with the tubing pipes beforehand.

* * * * *